US010422121B2

(12) United States Patent
Keville

(10) Patent No.: US 10,422,121 B2
(45) Date of Patent: Sep. 24, 2019

(54) SYSTEMS AND METHODS FOR CREATION OF INFLATABLE RIGIDIZABLE CEMENTITIOUS BUILDINGS

(71) Applicant: Samuel Arthur Keville, Long Beach, CA (US)

(72) Inventor: Samuel Arthur Keville, Long Beach, CA (US)

( * ) Notice: Subject to any disclaimer, the term of this patent is extended or adjusted under 35 U.S.C. 154(b) by 0 days.

(21) Appl. No.: 15/656,489

(22) Filed: Jul. 21, 2017

(65) Prior Publication Data

US 2019/0024361 A1 Jan. 24, 2019

(51) Int. Cl.

| | |
|---|---|
| ***E04B 1/16*** | (2006.01) |
| ***E04B 1/19*** | (2006.01) |
| ***E04C 2/34*** | (2006.01) |
| ***E04H 15/20*** | (2006.01) |

(52) U.S. Cl.

CPC ..... *E04B 1/169* (2013.01); *E04B 1/19* (2013.01); *E04C 2/34* (2013.01); *E04H 15/20* (2013.01); *E04B 2103/02* (2013.01); *E04C 2002/3488* (2013.01)

(58) Field of Classification Search

USPC ..... 52/2.15

See application file for complete search history.

(56) References Cited

U.S. PATENT DOCUMENTS 3,118,010 A * 1/1964 Harrington ..... E04G 11/04 264/32
3,225,413 A * 12/1965 Bird ..... E04G 11/04 264/314
3,779,847 A 12/1973 Turner
4,041,671 A * 8/1977 Nicholson ..... E04B 1/166 52/2.15
4,125,981 A * 11/1978 MacLeod ..... E04B 1/161 52/309.12
4,155,967 A * 5/1979 South ..... E04B 1/169 264/32
4,678,157 A * 7/1987 Fondiller ..... B28B 1/32 249/65
4,723,751 A * 2/1988 Hale ..... E04G 11/04 249/13
4,746,471 A * 5/1988 Hale ..... E04G 11/04 264/32

(Continued)

FOREIGN PATENT DOCUMENTS

WO 2019018715 A1 1/2019

OTHER PUBLICATIONS

Foreign Communication from a Related Counterpart—International Search Report and Written Opinion, dated Oct. 30, 2018, PCT/US2018/042998, filed on Jul. 20, 2018.

*Primary Examiner* — Brian E Glessner
*Assistant Examiner* — Adam G Barlow

(57) ABSTRACT

A system for creating a cementitious building includes a support structure comprising a plurality of support members, and an inflatable rigidizable structural (IRS) form. The IRS form comprises a plurality of geosynthetic cementitious composite mat (GCCM) sections having GCCM configured to absorb water and rigidize in response to hydration, each GCCM section being coupled to another GCCM section of the plurality such that the IRS form is pneumatically inflatable.

20 Claims, 17 Drawing Sheets

(56) References Cited

U.S. PATENT DOCUMENTS

| | | | | |
|---|---|---|---|---|
| 4,799,982 | A * | 1/1989 | Vicino | B28B 7/22 156/71 |
| 5,400,999 | A * | 3/1995 | Pavie | E04G 11/045 249/27 |
| 6,463,699 | B1 | 10/2002 | Bailey et al. | |
| 8,287,982 | B2 * | 10/2012 | Brewin | D04B 21/16 428/86 |
| 8,343,609 | B2 * | 1/2013 | Crawford | D04B 21/14 428/70 |
| 8,752,336 | B1 * | 6/2014 | Ozsuer | F41H 5/24 52/2.15 |
| 8,813,433 | B2 * | 8/2014 | Wilsey | E04B 1/161 52/411 |
| 2004/0045227 | A1 | 3/2004 | South | |
| 2009/0145046 | A1 * | 6/2009 | Thoeny | E04H 15/20 52/2.15 |
| 2014/0170916 | A1 * | 6/2014 | Krasnoff | E04C 5/07 442/58 |
| 2014/0360116 | A1 | 12/2014 | Miller et al. | |

* cited by examiner

SYSTEMS AND METHODS FOR CREATION OF INFLATABLE RIGIDIZABLE CEMENTITIOUS BUILDINGS

BACKGROUND

In building construction, structures are conventionally erected using wood, structural steel, masonry, on-site casted concrete, off-site precast concrete, or sprayed concrete (occasionally referred to as shotcrete). Precast concrete is a construction product produced by casting (i.e., pouring) concrete into a reusable mold, curing the concrete off-site in a controlled environment until cured panels form, removing the panels from the mold, each panel transported to the construction site and lifted into place, where multiple (already cured) panels are attached together on-site. On-site casted concrete is a construction product produced by creating molds on-site, pouring standard concrete into the molds, and allowing the poured concrete to cure on site before the mold is removed. Sprayed concrete is a concrete product conveyed through a hose and projected onto a surface that is reinforced by conventional steel rods, steel mesh, and/or fibers (e.g., steel or synthetic). These methods also create a large amount of waste products that cannot be reused in the building of other structures. The turn-around time for constructing a building can affect the overall cost of construction, and therefore it may be desirable to reduce the time it takes to construct buildings.

SUMMARY

In an embodiment, a system for creating a cementitious building includes a support structure comprising a plurality of support members, and an inflatable rigidizable structural (IRS) form. The IRS form comprises a plurality of geosynthetic cementitious composite mat (GCCM) sections having GCCM configured to absorb water and rigidize in response to hydration, each GCCM section being coupled to another GCCM section of the plurality such that the IRS form is pneumatically inflatable.

In an embodiment, a method for creating a cementitious building, the method comprises: inflating an IRS form, forming one or more rectilinear forms from the IRS form using a support structure, wherein the support structure comprises a plurality of support members, rigidizing the IRS form while maintaining the inflation of the IRS form, and forming the cementitious building based on the rigidizing of the IRS form.

In an embodiment, an air beam configured to facilitate creation of a cementitious building comprises a layer of cementitious composite material coupled together to form a closed structure. The closed structure is inflatable, and the closed structure when inflated forms a structural support element.

In an embodiment, a system for creating a cementitious building via inflation and hydration is disclosed. The system comprises a support structure and an IRS form. The support structure comprises a plurality of support members, where the plurality of support members of the support structure are configured to provide a framework. The IRS form comprises a plurality of GCCM sections having geosynthetic cementitious composite material (GCCM) configured to absorb water and rigidize in response to hydration, each GCCM section being coupled to another GCCM section of the plurality such that the IRS form is pneumatically inflatable without using a separate inflatable bladder inside the IRS form. The GCCM sections are configured to provide non-planar surfaces for transitioning between planar surfaces of the IRS form in response to pneumatic inflation A method of creating a cementitious building via inflation and hydration is disclosed according to an embodiment. The method comprises providing a foundation adapted to support a support structure, the support structure comprising a plurality of support members; anchoring at least one of the plurality of support members of the support structure to at least a portion of the foundation, where the plurality of support members of the support structure are configured to provide a framework over the foundation; providing an IRS form, where the IRS form comprises a plurality of GCCM sections, each GCCM section being coupled to another GCCM section of the plurality such that the IRS form is pneumatically inflatable, where the GCCM sections are configured to provide non-planar surfaces for transitioning between planar surfaces of the IRS form in response to pneumatic inflation; aligning the IRS form on the foundation such that the framework restrains the IRS form in response to inflation; pneumatically inflating the IRS form; hydrating each of the plurality of GCCM sections of the IRS form while maintaining pneumatic inflation, where each of the GCCM sections comprises a GCCM that is configured to rigidize in response to hydrating; and maintaining pneumatic inflation at least until some of the GCCM sections rigidize based on the hydrating.

A method for creating a cementitious building via inflation and hydration is disclosed according to another embodiment. The method comprises providing an IRS form that comprises a plurality of GCCM sections, at least one of the plurality of GCCM sections comprising an air beam; pneumatically inflating the IRS form without using a separate inflatable bladder inside the IRS form; hydrating each of the plurality of GCCM sections of the IRS form while maintaining pneumatic inflation, where each of the GCCM sections comprises a GCCM that is configured to rigidize in response to the hydrating; and subsequent to hydrating, maintaining pneumatic inflation until at least some of the GCCM sections rigidize based on the hydrating.

An air beam that is operable to facilitate creation of a cementitious building is disclosed according to an embodiment. In this embodiment, the air beam comprises a first layer of cementitious composite material; a second layer of cementitious composite material; and a plurality of rigidizable connectors disposed between the first layer and the second layer so as to define an air beam cavity between each rigidizable connector, where at least one rigidizable connector is configured to rigidize in response to introduction of water within the air beam cavity.

A system for providing an IRS form to facilitate construction of a cementitious building via inflation and hydration is disclosed according to an embodiment. The system comprises a computer system, which can comprise a processor communicatively coupled to a non-transitory memory storing an application that configures the processor upon execution such that the computer system: receives input of three dimensional coordinates defining a plurality of material sections to create the IRS form; detects a transition in orientation between two of the plurality of material sections based on the three dimensional coordinates; determines that the transition corresponds with material sections forming one or more of a non-planar surface, an oblique angle, a right angle, or a combination thereof; pulls, from non-transitory memory based on the determined transition, a securing pattern for physically coupling material sections together.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
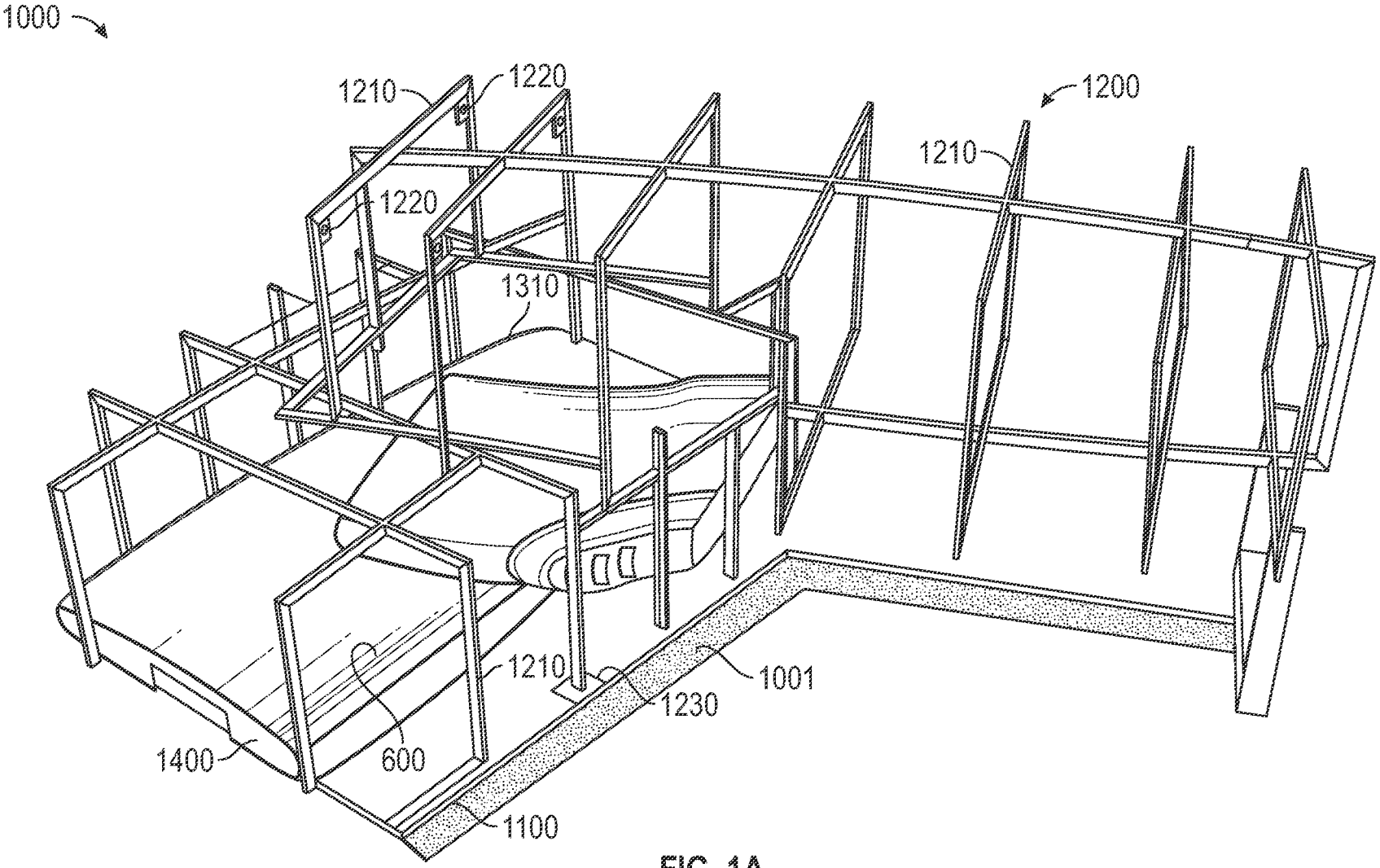
FIG. 1A illustrates an isometric view of portion of a system for creating a cementitious building according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, features, and techniques illustrated and discussed herein, but may be modified within the scope of the appended claims along with their full scope of equivalents.

The present systems and methods allow for the development and deployment of a building structure which, through the connection of GCCM and a light rigid frame, is able to create a determinable rectilinear building shell. This shell is a symbiotic relationship where without the rigid frame, the GCCM may not be able to hold the rectilinear form and the frame is able to become a rigid diaphragm using far less support than if erected alone. This system provides a fully sustainable, recyclable, non-wood construction which is stronger, lighter, and more efficient to build then traditional building systems. Combined, this makes it more desirable than other building systems in existence today.

Conventionally, inflatable forms are implemented in the commercial setting as temporary structures and require the use of continued inflation in order for the inflated structure to remain erect. For example, plastic or fabric materials may be glued or joined together and inflated to form a "bounce house" for a child's birthday party, an inflatable archway through which runners pass at the finish line of a marathon, or an inflated interactive game course (such as an inflated boxing ring or running maze) that provides an inflated cushion to help prevent injuries of adults or children playing games. Thus, due to the requirement of continuous pneumatic inflation, these structures are not suitable for permanent structures such as commercial and/or residential buildings. In some instances, attempts have been made at making inflatable structures more permanent in nature by inflating a bladder, then pouring and/or spraying concrete over the bladder. However, the application of poured and/or sprayed concrete may lead to uneven or non-uniform material thickness, while also being limited to structural shapes similar to a dome or hut, thereby creating substantially non-rectilinear structures. This is in contrast to most commercial and/or residential buildings which are substantially rectilinear in shape.

Aside from aesthetics of a building, in most urban and rural areas, construction of commercial and/or residential buildings must conform to governmental regulations, standards, and codes in order to pass inspection and be authorized for use in commercial and/or residential settings. As such, conventional construction processes and techniques implement interior frames made out of wood, metal, and/or masonry to erect the load-bearing structure of the building, thereby defining its shape. Once the load bearing skeleton frame is erected, construction workers then create a façade (e.g., preformed concrete pieces, bricks, stucco, vinyl siding, etc.) for aesthetic purposes. For large commercial buildings, conventional techniques may implement reinforced concrete beams and piles that use poured concrete with steel rebar embedded therein. These conventional methods may be time consuming and may require narrow time windows in which concrete can be poured before it sets.

In some construction projects, a concrete lining may be helpful to prevent erosion or line ditches. Instead of pouring or spraying concrete for ditch lining or slope protection, a GCCM can be used, where the GCCM is a three-dimensional flexible cement impregnated fabric material that hardens upon hydration to form a durable concrete layer. This GCCM has at least one surface that is permeable to water, through which water will penetrate into the embedded cement mixture upon hydration. Once water is applied to the material, the cement mixture embedded therein begins to cure and will harden in place after a defined time. Conventionally, this GCCM is used as a liner and not implemented in load-bearing applications. Some have attempted to use this GCCM in structural, load-bearing applications, but the construction techniques require the use of an internal inflatable bladder with strips of GCCM over the bladder, thereby limiting the shapes of the resulting structures to that of a dome or hut and/or other substantially non-rectilinear shapes. As such, these structures may not conform to governmental building codes or regulations. Additionally, consumers may find domes or huts unappealing due to their aesthetics, and thus may not be marketable to traditional buyers and/or tenants. These conventional systems each have their inefficiencies in turn-around time, high material costs, and skilled labor needs; therefor it may be desirable to reduce time, material, and labor in constructing buildings.

The present disclosure describes illustrative embodiments of systems and methods that provide a more rapid and robust manner by which substantially rectilinear cementitious buildings can be created and erected via inflation and hydration for commercial and/or residential environments without the use of separate internal inflatable bladders.

Embodiments of the present disclosure include systems and methods for creating a cementitious building via inflation and hydration. In some embodiments, the system includes a support structure that allows the shape of the inflatable structure to be controlled. The support structure can have a number of different configurations, and in some embodiments, the support structure can integrate with the inflatable structure such that upon curing, the final structure is a combination of the inflated structure and the support structure. The support structure can include a plurality of support members, where the plurality of support members of the support structure can be configured to provide a framework. This allows the support structure to restrain the IRS form from over-expansion and facilitates the formation of walls and/or the ceiling of the cementitious structure. The sides of the resulting structure can be formed to be flat and have an overall rectilinear shape through the combination of the support structure and an inflatable rigidizable material.

The system can also include the IRS form comprising a plurality of GCCM sections having GCCM configured to absorb water and rigidize in response to hydration. Each GCCM section can be coupled to another GCCM section of the plurality such that the IRS form can be pneumatically inflatable without using a separate inflatable bladder inside the IRS form, and the GCCM sections can be configured to provide non-planar surfaces for transitioning between planar surfaces of the IRS form in response to pneumatic inflation.

In some embodiments, a method comprises providing a foundation adapted to support a rigid support structure, which can take the form of an exoskeleton support structure comprising a plurality of support members. At least one of the plurality of support members of the support structure can be anchored to at least a portion of the foundation, and the plurality of support members of the support structure can form a framework over the foundation. An IRS form can thereby be provided that comprises a plurality of GCCM sections. Each GCCM section can be coupled to another GCCM section of the plurality such that the IRS form is pneumatically inflatable, and the GCCM sections can be configured to provide non-planar surfaces for transitioning between planar surfaces of the IRS form in response to pneumatic inflation. The method comprises aligning the IRS form on the foundation such that the framework restrains the IRS form in response to inflation, and then pneumatically inflating the IRS form. The method includes hydrating each of the plurality of GCCM sections of the IRS form while maintaining pneumatic inflation, where each of the GCCM sections comprises a GCCM that is configured to rigidize in response to hydrating. The method also comprises maintaining pneumatic inflation at least until some of the GCCM sections rigidize based on the hydrating.

In another embodiment of the present disclosure, a method comprises providing an IRS form that comprises a plurality of GCCM sections, at least one of the plurality of GCCM sections comprising an air beam. The method includes pneumatically inflating the IRS form without using a separate inflatable bladder inside the IRS form, and hydrating each of the plurality of GCCM sections of the IRS form while maintaining pneumatic inflation, where each of the GCCM sections comprises a GCCM that is configured to rigidize in response to the hydrating. Subsequent to hydrating, the method includes maintaining pneumatic inflation until at least some of the GCCM sections rigidize based on the hydrating.

The support structure can comprise a variety of configurations, including the use of structural elements such as beams, posts, cables, etc. In some embodiments, some or all of the structural elements can take the form of air beams. In general, air beams comprise inflatable elements that when inflated can provide a structural frame or support member as part of the support structure. As an example, an air beam can be a tubular piece of GCCM that can be fixed at one or more points and inflated to form a structure. Through the proper use of sewing patterns, the air beam can have a variety of shapes such as arches, post and beam, framework structures, or the like. In some embodiments, the air beam can comprise a plurality of inflatable elements disposed along a planar GCCM member. The resulting air beam can take an inflated form of a relatively flat section. The air beams can be integrated with the rigidizable inflatable structure (e.g., sewn into the structure), or include a separate structure that can be separately inflated. In either instance, the air beams can generally be inflated separately from the rigidizable inflatable structure, and as a result, can be inflated to a different final inflation pressure.

Figure 1B:
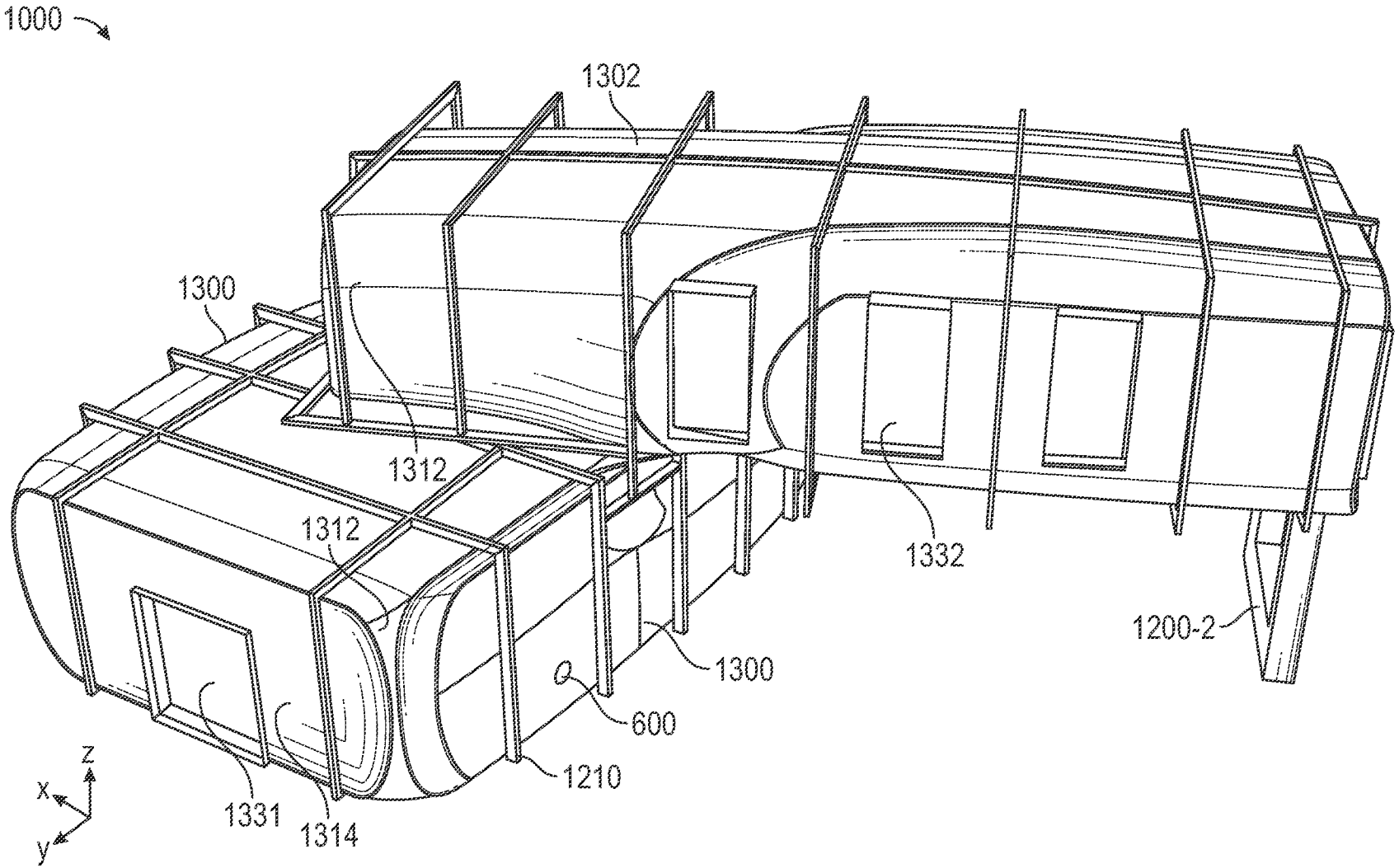
FIG. 1B illustrates a second isometric view of the system of FIG. 1A.
Figure 1C:
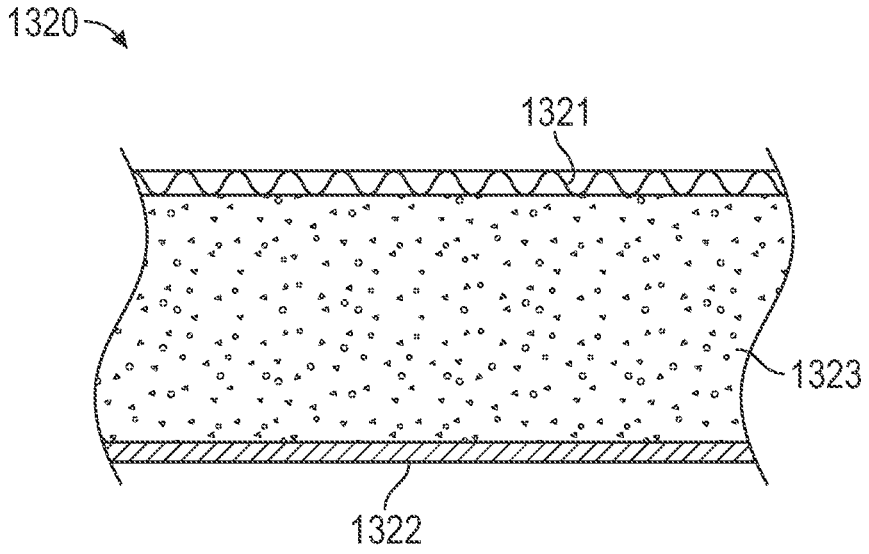
FIG. 1C illustrates a cross-sectional view of GCCM implemented in embodiments of the disclosure.

Turning now to FIGS. 1A-1C, a system 1000 for creating cementitious buildings via hydration and inflation is disclosed. The system 1000 comprises an inflatable rigidizable structure (IRS) and a support structure 1200. In general, the IRS is formed from GCCM in a connection pattern that can be inflated and have a final form. Since the inflation of the GCCM tends to result in bulging or rounding due to the inflation pressure, the support structure 1200 can be used to control the final inflation structure. As shown in FIG. 1B, once inflated, the final structure can include a generally rectilinear shape formed from the IRS as restrained by the support structure 1200. As described in more detail below, the support structure 1200 can be coupled to the IRS such that the support structure both helps to define the final shape and form of the overall structure while also providing structural support to the final structure. By connecting the GCCM sections in a predetermined pattern, a final determinable structure and form can be provided. As a result, the overall structure can take a variety of final shapes and forms, be quickly constructed, and be environmentally sustainable by limiting the use of building materials.

The IRS form 1300 comprises a plurality of GCCM sections 1310, where each GCCM section 1310 is coupled together by joints 1400, which will be later discussed in detail with reference to FIGS. 4A-4F. Each GCCM section 1310 is coupled to another GCCM section 1310 such that the IRS form 1300 is pneumatically inflatable, and such pneumatic inflation occurs without using an inflatable bladder disposed inside the IRS form 1300 (and/or without the interior surface of the IRS form 1300 being bonded to an outer surface of an inflatable bladder and/or inner liner disposed within the IRS form 1300). Each GCCM section 1310, and thus the IRS form 1300, comprises GCCM 1320, which is discussed in detail with reference to FIG. 1C. As such, the IRS form 1300 is configured to be inflatable because the GCCM sections 1310 are coupled using joints 1400 so as to be operable to retain a higher gas pressure inside a cavity 1331 (defined by the IRS form 1300) than the ambient pressure of the environment outside of the IRS form 1300. Inflation of the IRS form 1300 temporarily provides structural integrity via gas pressure differential that causes expansion of the cavity 1331, thereby maintaining the shape and cross-section of IRS form 1300 before and during hydration of cementitious composite material 1320. The IRS form 1300 is configured to be "rigidizable" because before and/or in response to inflation, the GCMM sections 1310 are hydrated to initiate curing of the cementitious composite material 1320, thereby hardening the GCMM sections 1310 into the shape and cross-section provided during inflation. The hydration of cementitious composite material 1320 facilitates the transition of the IRS form 1300 into a rigid and/or semi-rigid cementitious building.

The IRS 1300 defines a cavity 1331 in response to inflation. As illustrated in FIG. 1A, the IRS form 1300 can initially arrive to the intended construction site in a deflated (i.e., uninflated) state, such as illustrated in FIG. 1A which shows a portion of IRS form 1300 aligned on foundation 1100 and disposed underneath a support structure 1200. FIG. 1B shows an embodiment of IRS form 1300 once inflation has occurred. For clarity purposes, foundation 1100 has been omitted from illustration in FIG. 1B, however it is understood that the system 1000 may continue to comprise foundation 1100.

When inflated, the IRS 1300, in combination with the support structure 1200, can take a variety of forms. For example, the final structure can comprise a one-story rectilinear structure such as a rectangular or square building, a T or H structure building, a W shaped building, or the like. In some embodiments, the final structure may have angled interfaces while still having relatively flat sides (e.g., a V type structure with a non-ninety degree angled sections, curved sections, etc.). In addition, as shown in FIG. 1B, multi-story buildings can also be constructed from a single IRS. For example, a single IRS can be inflated and used with the support structures to have a two-story, three-story, or higher building. As shown, when the IRS forms a final multi-story building, the stories do not have to be aligned, but can be formed with overlapping portions to provide for interior design and connection between the portions of the final structure. While some specific shapes and structures are noted herein, the use of the IRS is not limited to these structures, and the final structure can take a variety of shapes and sizes.

As illustrated in FIG. 1C, an embodiment of GCCM 1320 comprises a first surface 1321, a second surface 1322, and a cementitious matrix material 1323 disposed therebetween. At least one of the first surface 1321 or second surface 1322 is configured to be permeable to liquid, such as portable and/or non-potable water. In an embodiment, each of the first surface 1321 and the second surface 1322 is permeable to liquid. The cementitious matrix material 1323 comprises a three-dimensional fiber matrix having a dry concrete mix that begins to cure in response to water, and thus the GCCM 1320 is considered a flexible, concrete impregnated fabric that hardens (i.e., rigidizes) when hydrated. Put simply, the GCCM 1320 is configured to absorb water and rigidize in response to hydration, such as hydration with water. Hydration may occur via at least one of immersion, targeted application (e.g., spraying water from a nozzle), or a combination thereof. In an embodiment, an air and water vapor mixture (i.e., humid air) may be applied to portions of the IRS form 1300 to facilitate hydration. In some embodiments, one surface of the GCCM 1320 is configured to be substantially liquid impermeable (e.g., via a plastic lining that prevents at least 90% water penetration through that surface) and/or be chemically resistant (e.g., via a geomembrane backing configured to provide resistance to chemicals, weathering, and/or Ultra Violet light degradation) as long as the other surface (i.e., either first surface 1321 or second surface 1322) remains liquid permeable and configured to allow for hydration. The IRS form 1300 does not comprise a separate inflatable inner bladder used for inflation. Thus, an inner bladder (e.g., a plastic inner bladder) is not disposed within, bonded to, coupled to, and/or in contact with the GCCM 1320 during inflation because the IRS form 1300 is configured to be pneumatically inflatable without using a separate inflatable bladder and/or without having an inner liner bonded to the interior of the IRS form 1300.

Figure 2A:
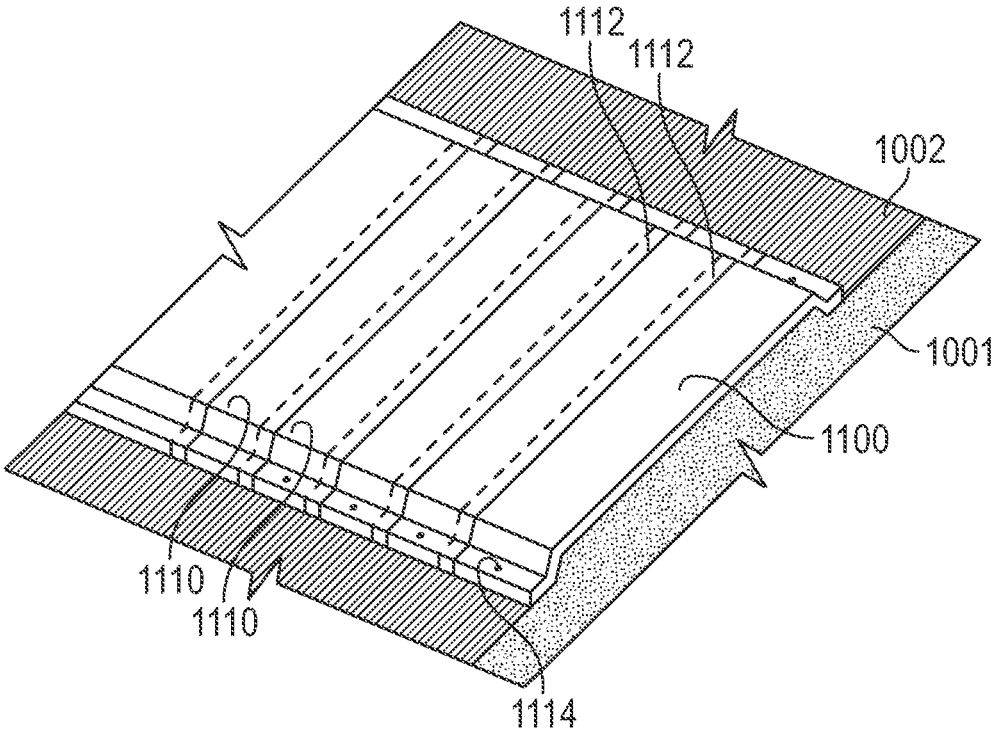
FIG. 2A illustrates an isometric view of a foundation used in the system shown in FIG. 1A according to an embodiment of the disclosure.
Figure 2B:
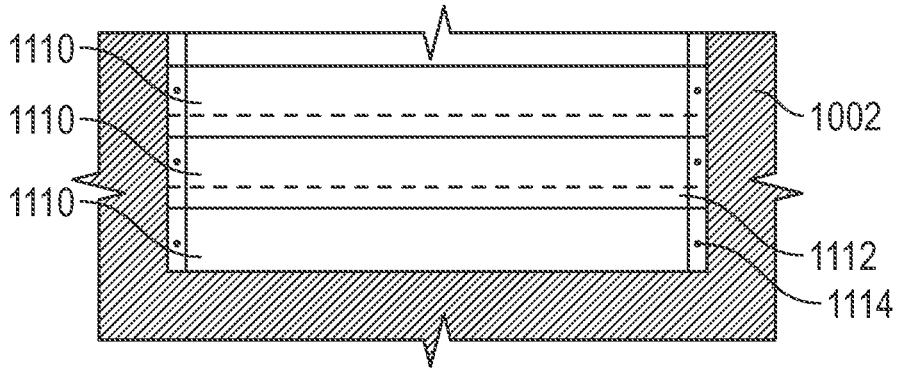
FIG. 2B illustrates an overhead view of a portion of the foundation of FIG. 2A.
Figure 2C:
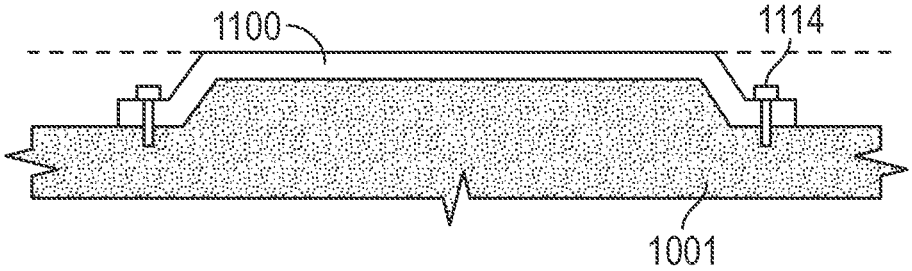
FIG. 2C illustrates a cross-sectional view of the foundation of FIG. 2A and FIG. 2B.

Turning to FIGS. 2A-2C with continued reference to FIG. 1A, the system 1000 comprises a foundation 1100. The foundation 1100 sits atop a substrate 1001, such as compacted gravel, soil, or other material located below the foundation 1100. In some embodiments, the foundation 1100 comprises a plurality of geosynthetic cementitious composite mats referred to as GCCM foundation sections 1110 when used for the foundation 1100. The GCCM foundation sections 1110 comprise the GCCM 1320 which is also used in the IRS form 1300. The GCCM foundation sections 1110 may be disposed over substrate 1001 and next to ground surface 1002. In an embodiment, the GCCM foundation sections 1110 have one or more foundation joints 1112 that coupled one GCCM foundation section 1110 to another adjacent GCCM foundation section 1110. In an embodiment, a foundation joint 1112 is created by hydrating the liquid permeable surface of each GCCM foundation section 1110 and overlapping the adjacent sections. Once hydrated, the GCCM foundation section 1110 may at least partially adhere to the adjacent section and rigidize (i.e., harden) as the material cures. In some embodiments, anchors 1114 may be used to couple GCCM foundation sections 1110 to each other and/or the substrate 1001. Examples of anchors 1114 include, but are not limited to, screws, nails, staples, and/or adhesives. In an embodiment, the foundation 1100 may comprise a poured concrete slab. The foundation 1100 is adapted to support at least the IRS form 1300 and support structure 1200. It is understood that foundation 1100 may be configured to comply with governmental regulations, standards, and/or building codes.

Returning to FIGS. 1A and 1B, the system 1000 also comprises a support structure 1200. In some embodiments, more than one support structure may implemented in system 1000, such as support structures 1200 and 1200-2 which are substantially similar to support structure 1200 shown in FIG. 1B. The support structure 1200 comprises a plurality of support members 1210. Examples of support members 1210 include, but are not limited to, beams made of wood, metal, alloy, synthetic plastic, GCCM, or a combination thereof. Flexible elements such as cables, ties, or the like can also be used as part of the support structure 1200. The support members 1210 are coupled together such that the support structure is configured to provide a framework structure that can be disposed around and/or underneath at least a portion of the IRS form 1300. For example, FIG. 1A shows uninflated IRS form 1300 having GCCM sections 1310 that will form walls of the cementitious building once inflated and hydrated, and these walls are between the support members 1210 support structure 1200. Similarly, FIG. 1A shows two support members 1210 disposed above a GCCM section 1310 of IRS form 1300 that will form a ceiling once IRS form 1300 is inflated, hydrated, and cured. Once IRS form 1300 is inflated, as shown in FIG. 1B, at least some of the support members 1210 of the support structure 1200 restrain at least some of the GCCM sections 1310 from further outward expansion.

In some embodiments, the support structure 1200 comprises hoists 1220 that may be disposed in the corners of the framework formed by support members 1210. The hoists 1220 can be configured to have attachment elements (e.g., hooks, carabiner, shackle, lift trunnion, or other connector) that are removably engagable with GCCM sections 1310 in order to facilitate expansion of the IRS form 1300 during inflation. For example, a GCCM section 1310 may be configured with a loop that engages with an attachment element (e.g., a hook) of the hoist 1220, and the hoist 1220 can provide lift to portions of the GCCM section 1310 to help guide the walls and/or ceiling of the IRS form 1300 into the desired position during inflation and hydration. This may help to facilitate the IRS form 1300 forming planar surfaces, right angles, oblique angles, and/or the predefined shape once the cementitious composite material 1320 hardens. The support structure 1200 can be anchored to foundation 1100 at specific locations, such as support member 1210 being coupled to foundation 1100 at anchor location 1230 (e.g., via the use of brackets). In some embodiments, support structure 1200 remains in place after pneumatic inflation is removed and the IRS form 1300 has hardened to create the cementitious building. In some embodiments, at least one of the plurality of support members 1210 can be wrapped in the GCCM 1320 such that when the IRS form 1300 is inflated, the wrapped support member 1210 and at least one of the GCCM sections 1310 comes into contact with each other. Once hydration occurs, the wrapped support member 1210 and the at least one GCCM section 1310 may adhere or fuse to each other. In some embodiments, the support members can be coupled (e.g., using a connection mechanism such as a bolt, screw, rivet, anchor, or the like) to the IRS form 1300 such that the support structure 1200 is structurally and mechanically connected to the IRS form 1300 in the final structure. As a result, the final structure may comprise an integrated structure comprising both the IRS form 1300 integrated and connected to the support structure 1200.

In some embodiments, the support structure 1200 may only be used during inflation and formation (e.g., rigidizing) of the final inflated IRS form 1300. Once the IRS form 1300 has been hydrated and rigidized, the support structure 1200 can be removed from the site. In this embodiment, the support structure 1200 serves to support the IRS during inflation and curing of the IRS form 1300, but it not needed for the final structural support. When the support structure 1200 is removed, all or only a portion of the support structure 1200 may be removed. For example, a portion of the support structure 1200 may remain to support portions of the final form, while other elements used for shaping and formation of the final IRS form 1300 during inflation can be removed.

As illustrated in FIG. 1B, in some embodiments, multiple support structures (e.g., any of 1200 and/or 1200-2) may be implemented based on the inflated shape of the IRS form 1300 and/or IRS form 1302. The support structures 1200-2 may be substantially similar to the support structure 1200 discussed with respect to IRS form 1300. For example, the inflatable form 1300 may have a second story disposed at least partially on top of the first story of what will become the final cementitious building (once inflated, hydrated, and rigidized). The second story of the cementation building may be constructed via the use of a second IRS(IRS) form 1302. Thus, in some embodiments, the second IRS form 1302 creates a second story because at least some of the second IRS form 1302 is disposed at an elevation above the IRS form 1300. In some embodiments, the second IRS form 1302 is a part of IRS form 1300 (i.e., IRS form 1300 comprises second IRS form 1302 because at least some GCCM sections 1310 are coupled to at least some GCCM sections 1312). In some embodiments, the IRS form 1300 and the second IRS form 1302 are in fluid communication with each other during inflation. Put another way, in some embodiments, the IRS form 1300 and second IRS form 1302 (which may create a bottom and top story of the cementitious building) can be a single IRS that is inflated at the same time. In an embodiment, at least a portion of the second IRS form 1302 is disposed above the IRS form 1300 and/or support structure 1200. In some embodiments, a support structure 1200-2 is disposed beneath at least a portion of the second IRS form 1302 so as to support at least some of the second IRS form 1302 (e.g., a portion that is cantilevered off of the IRS form 1300 as illustrated in FIG. 1B).

The second IRS form 1302 comprises a second plurality of GCCM sections 1310. The second plurality of GCCM sections 1310 are configured to define a second cavity 1332 for second IRS form 1302. As used herein, the term "second cavity 1332" refers to the cavity defined by the second IRS form 1302. In some embodiments, the cavity 1331 (which may be referred to as a "first cavity") defined by the first plurality of GCCM sections 1310 is in fluid communication with the second cavity 1332 defined by the second plurality of GCCM sections 1312. Both the GCCM sections 1310 and the GCCM sections 1312 may be configured to provide non-planar surfaces 1312 for transitioning between planar surfaces 1314 of the IRS form 1300 and/or 1302, and these planar surfaces 1314 and non-planar surfaces 1312 form the shape of the cementitious building once inflation and hydration occurs. The second plurality of GCCM sections 1310 (and thus the second IRS form 1032) comprise the GCCM 1320 previously discussed. As such, the second IRS form 1302 is configured to be pneumatically inflated. Once inflation occurs, the GCCM sections 1310 can be hydrated while pneumatic inflation within the first cavity 1331 and/or second cavity 1332 is maintained, which in turn causes the cementitious composite material 1320 to harden, thereby rigidizing the second IRS form 1302. Inflation of each of IRS form 1300 and second IRS form 1302 may be maintained until each of the first plurality of GCCM sections 1310 and the second plurality of GCCM sections 1310 rigidize based on hydration.

Figure 3A:
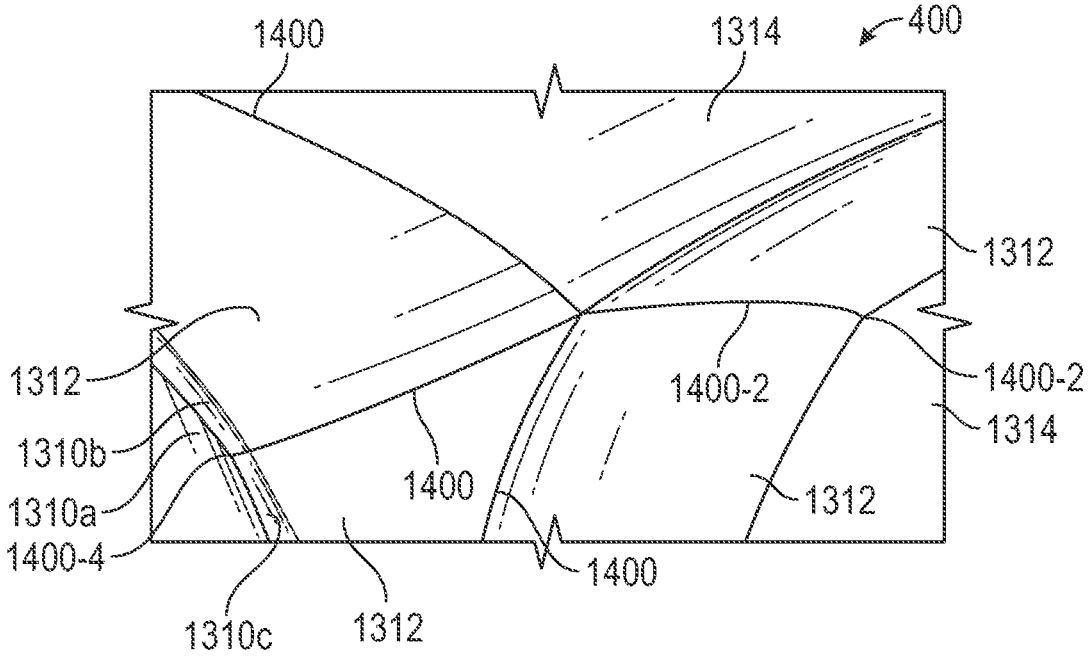
FIG. 3A illustrates a view of a portion of the system of FIG. 1A and FIG. 1B according to an embodiment.
Figure 3B:
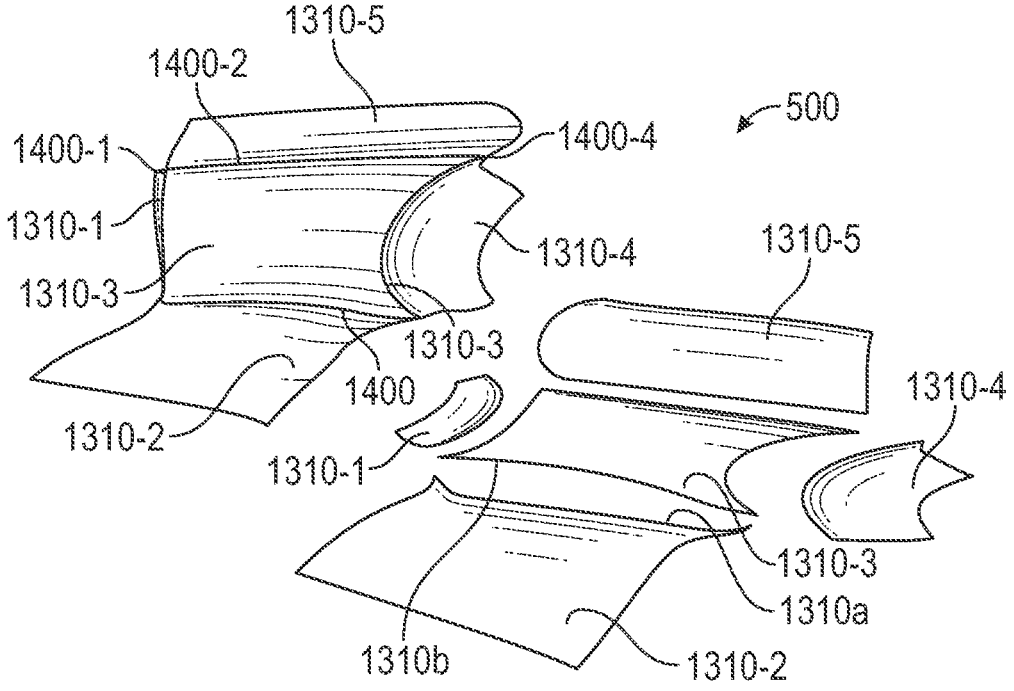
FIG. 3B illustrates an isolated view of portions of the system as shown in FIG. 1B.
Figure 3C:
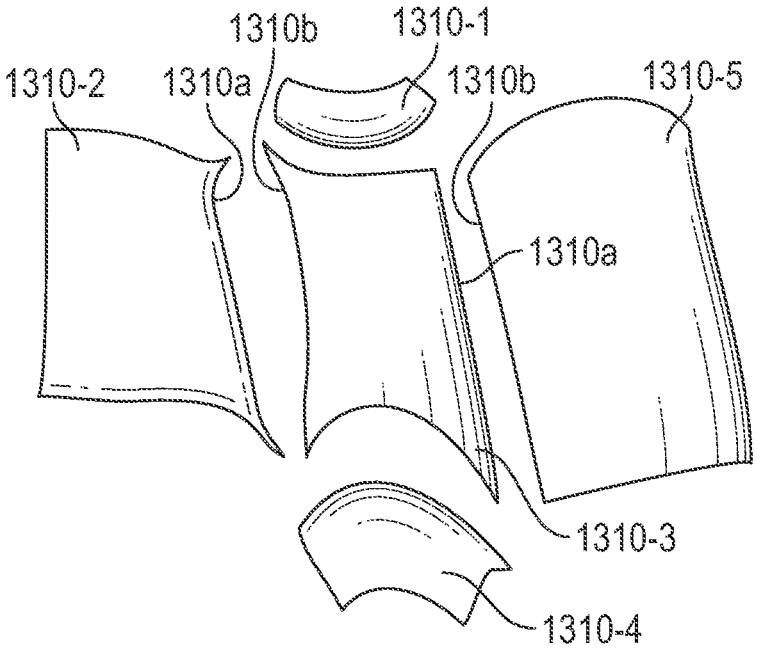
FIG. 3C illustrates an overhead view of the portions of the system as shown in FIG. 1B and FIG. 3B.

Turning to FIGS. 3A-3F with continued reference to FIGS. 1A and 1B, the IRS form 1300 is comprised of GCCM sections 1310 that create planar surfaces 1314 and non-planar surfaces 1312 in response to inflation. FIG. 3A shows an example view 400 in which multiple GCCM sections 1310 couple together at joints 1400. Instead of the IRS form 1300 being confined only to generally rounded shapes such as a dome or hut (or other non-rectilinear shapes), the IRS form 1300 is configured to provide joints that facilitate transition between planar surfaces 1314 (e.g., between adjacent walls and/or a ceiling) based on the shape of the edges of each GCCM section 1310. The edges of each GCCM section 1310 are coupled together at joints 1400. For example, as illustrated in FIGS. 3B and 3C, individual GCCM sections 1310 are initially independent from each other, with each being cut from raw material into a specific configuration such that when coupled together, the GCCM sections 1310 create the substantially rectilinear building.

During manufacturing of the IRS form 1300 (and/or the second IRS form 1302), the GCCM sections 1310-1, 1310-2, 1310-3, 1310-4, and 1310-5 may be oriented so that their respective edges compliment each other according to the joint that will be implemented to transition between one GCCM section being a non-planar surface and the other being a planar surface. For example, as illustrated in FIGS. 3A-3C, GCMNI section 1310-2 has an edge 1310*a* that joins with edge 1310*b* of GCMNI section 1310-3. Similarly, GCCM section 1310-3 has an edge 1310*a* that joins with edge 1310*b* of GCMNI section 1310-5. GCCM section 1310-3 also joins with GCMNI section 1310-1 and 1310-4. FIG. 3B illustrates view 500 which shows the individual GCCM sections 1310-1 through 1310-5 laying flat before they are secured together (such as via joints 1400, 1400-1, 1400-2, 1400-3, 1400-4 discussed with respect to FIGS. 4A-4F), and also shows a partial view and orientation of these same GCCM sections once they are joined and inflated. The edges of GCCM sections (e.g., 1310-1 through 1310-5) may be configured with linear and/or arcuate shapes such that adjacent GCCM sections have complimentary edges (1310*a*-1310*c*) and provide transitions between planar 1314 and/or non-planar surfaces 1312 of IRS forms 1300, 1302. When the multiple GCCM sections are coupled together, the transition between the surfaces occurs via joints (e.g., 1400 through 1400-4). For example, in some embodiments, when two GCCM sections are coupled together, joint 1400 may be implemented. In some embodiments, joints 1400-1 through 1400-4 may be implemented when more than two GCCM sections 1310 are coupled together. Further discussion is provided with respect to FIGS. 4A-4F.

While described as not requiring a separate bladder, in some embodiments, an internal bladder could be used with the IRS form 1300, 1302. When combined with the use of the support structure 1200, such an embodiment may help to hold the inflation form during rigidizing of the IRS form 1300, 1302 and/or support structure 1200.

Figure 3D:
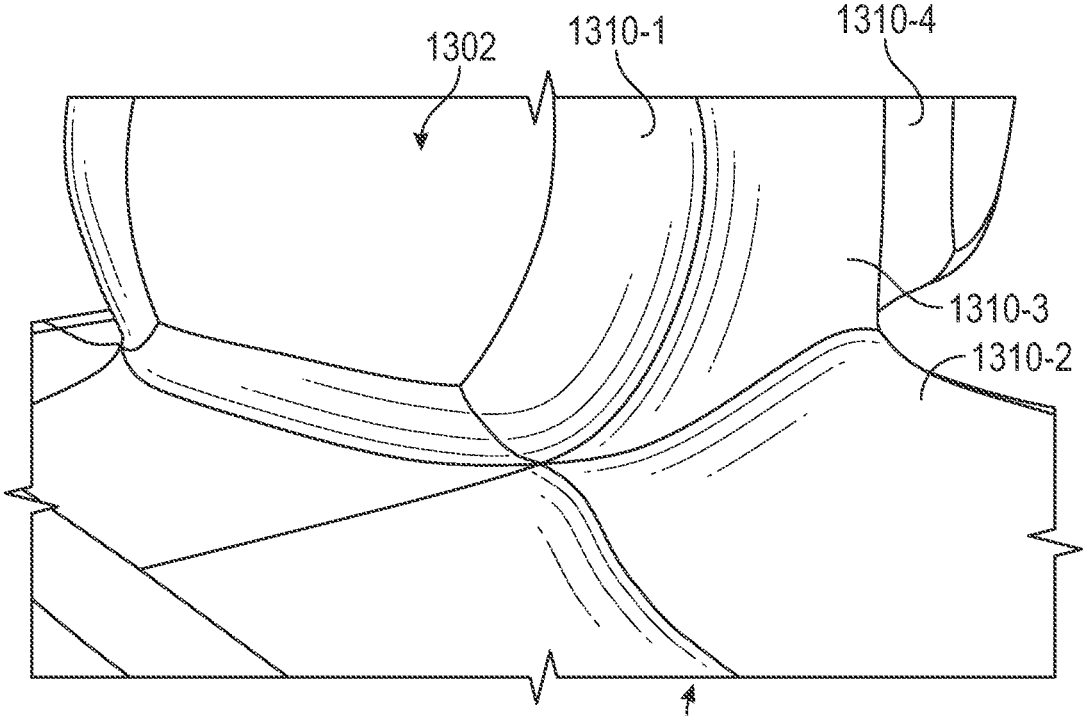
FIG. 3D illustrates an alternate isolated view of the system of FIG. 1A and FIG. 1B.
Figure 3E:
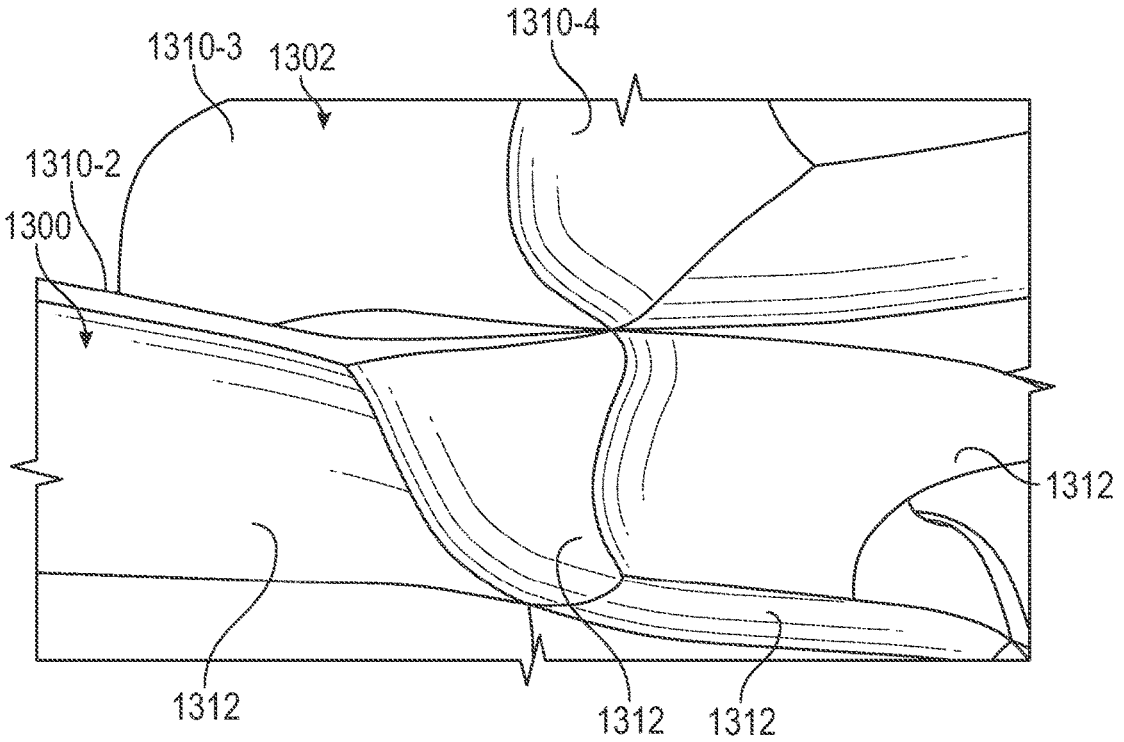
FIG. 3E illustrates a closer view of a portion of the system of FIG. 1A and FIG. 1B.

FIGS. 3D and 3E illustrate the orientation of GCCM sections 1310-1 through 1310-5 showing how the GCCM sections create a transition between IRS form 1300 to the second IRS form 1302. Specifically, the GCCM sections 1310 create non-planar surfaces 1312 for IRS form 1300. The GCCM sections 1310 pertain to the second IRS form 1302, which is illustrated as a second story of the cementitious building in the embodiment shown in FIGS. 1B, 3D, and 3E. The exterior surface of the GCCM sections 1310 of IRS forms 1300, 1302, respectively, are configured with the first surface 1321 of the GCCM 1320 facing outwards. This allows hydration of the IRS form 1300 and second IRS form 1302 by introduction of water (e.g., spraying, pouring, soaking) to initiate curing of the cementitious matrix material 1323, thereby allowing the IRS forms 1300, 1302 to rigidize.

Figure 3F:
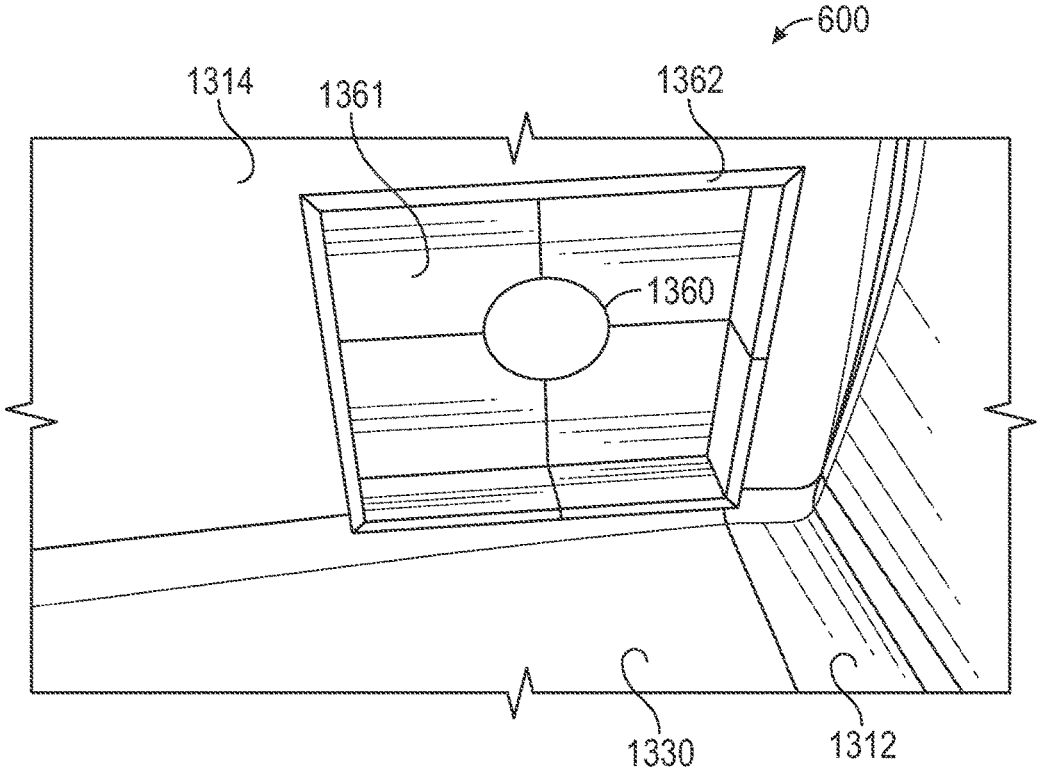
FIG. 3F illustrates a valve portion of the system as shown in FIG. 1B.

Turning to FIG. 3F, with continued reference to FIGS. 1A and 1B, a valve portion 600 of the system 1000 is shown. The valve 1360 that is configured to facilitate pneumatic inflation, hydration of at least one rigidizable connector, or a combination thereof. The IRS form 1300 comprises at least one valve 1360. In an embodiment, the valve 1360 can be a one-way valve that allows for pneumatic inflation. In some embodiments, each IRS form 1300, 1302 has its own valve 1360. The IRS forms 1300, 1302 may have one valve 1360 that can be configured for inflation and one valve 1360 that can be configured for pressure regulation and/or removal of gas and/or liquid that was injected within a cavity (e.g., cavity 1331 and/or 1332). When a valve 1360 is configured for pressure regulation and/or removal of gas and/or liquid, it may be referred to as an exit valve. The exit valve may be configured to prevent over expansion of the GCCM sections 1310 may release gas from the cavity when the internal pressure is above a defined threshold pressure. In some embodiments, the exit valve is configured to be adjustable such that the defined threshold pressure can vary depending on the amount of pressure required to inflate the IRS form 1300 prior to hydration. In an embodiment, the system 1000 may comprise a pneumatic pump and/or air compressor (not shown) that is used to inject gas into the cavities 1331, 1332 of IRS forms 1300, 1302, respectively. For example, the valve 1360 is configured to mechanically couple to the compressor so as to provide a pneumatic seal that facilitates pneumatic inflation with pressurized gas. In an embodiment, the valve 1360 may be configured to mechanically couple to a hydraulic pump so that liquid, such as water, can be injected into the cavities 1331, 1332 instead of, and/or in addition to a gas (e.g., air). When the internal pressure exceeds the defined threshold (e.g., 25 pounds per square inch (p.s.i)) of the exit valve, the exit valve may be configured to release this "excess" pressure until the internal pressure of the cavities 1331, 1332 falls below the defined threshold (e.g., for this example, falls below 25 p.s.i.).

In some embodiments, valve 1360 may be disposed within a frame 1362 that is coupled to one or more GCCM sections 1310. Each IRS form 1300, 1302 may comprise a plurality of frames 1362, irrespective of whether a valve 1360 is disposed within each frame 1362. In some embodiments, a frame 1362 may be configured to provide vertical and/or horizontal support for a door, window, entranceway, ducting, or other cutouts of the cementitious building. In some embodiments, a frame 1362 may be wrapped in GCCM 1320 and may be comprised within one of the GCCM sections 1310 that form planar surfaces 1314 and/or non-planar surfaces 1312. During manufacture, in some embodiments, the GCCM sections 1310 have cutouts at locations where doors, windows, or other openings are desired, and one or more frames 1362 are coupled (e.g., via wrapping frame members with GCCM 1320 and/or using joints 1400 through 1400-4) to the cutouts. The frames 1362 may comprise a sealing insert 1361 that attaches to the frame 1362. In some embodiments where a valve 1360 is disposed within the frame 1362, the sealing insert 1361 may be configured to surround the valve 1360 and attach to the frame 1362 so as to form a seal that prevents gas (e.g., air) and/or a liquid (e.g., water) from exiting and/or entering the cavity 1331, 1332. In some embodiments, sealing insert 1361 may be attached to frame 1362 while also allowing for temporary passage of persons and/or materials into a cavity 1331, 1332 from the external environment while inflation occurs. For example, in an embodiment, the sealing insert 1361 may comprise a zipper that is configured to maintain a pressure seal when closed (i.e., zipped up) but also provide a mechanism to introduce and/or remove matter (e.g., gas, liquid, materials, people) to and/or from a cavity 1331, 1332 independent from valve 1360. Thus, when an air compressor attached to valve 1360 begins to introduce gas so as to pneumatically inflate IRS form 1300, the sealing insert 1361 is configured to maintain a higher pressure inside cavity 1331, 1332 by mitigating gas and/or liquid passage through its surface. In the embodiment where sealing insert 1361 allows for temporary passage, a user (e.g., a construction worker) can temporarily break the seal (e.g., by unzipping the zipper), such as to pass materials into the cavity and/or walk inside the cavity. In some embodiments, the sealing insert 1361 and/or valve 1360 is configured to allow for removal of gas, liquid, and/or other material from the cavity 1331, 1332 after and/or during inflation.

Once inflation occurs and the GCCM sections 1310 have sufficiently hardened (i.e., rigidized), in some embodiments the sealing insert 1361 may be removed from the frame 1362, such as by cutting the sealing insert 1361 to expose the shape of frame 1362. This may allow for doors, windows, or other building elements to be passed through and/or attached to the frame 1362. In some embodiments, the sealing insert 1361 comprises GCCM 1320 and thus the sealing insert 1361 may become a part of the surrounding GCMNI section 1310 in response to hydration. In some embodiments, valve 1360 may be configured to be part of a GCCM section 1310 without being disposed within a frame 1362.

Figure 4A:
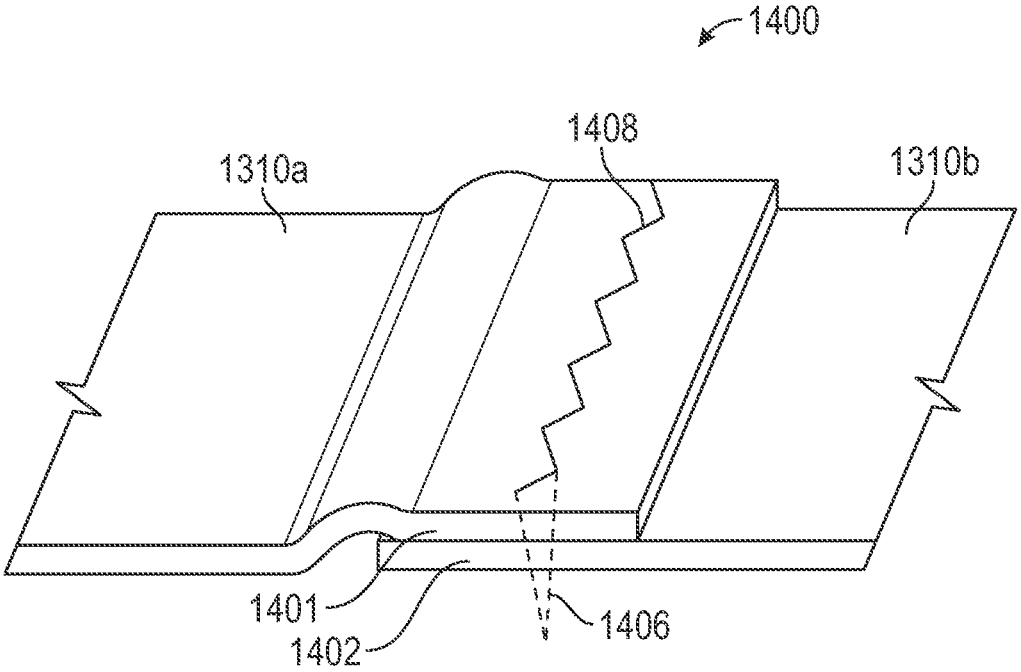
FIG. 4A illustrates an isometric view of an embodiment of a joint section operable in the system shown in FIG. 1A and FIG. 1B.
Figure 4B:
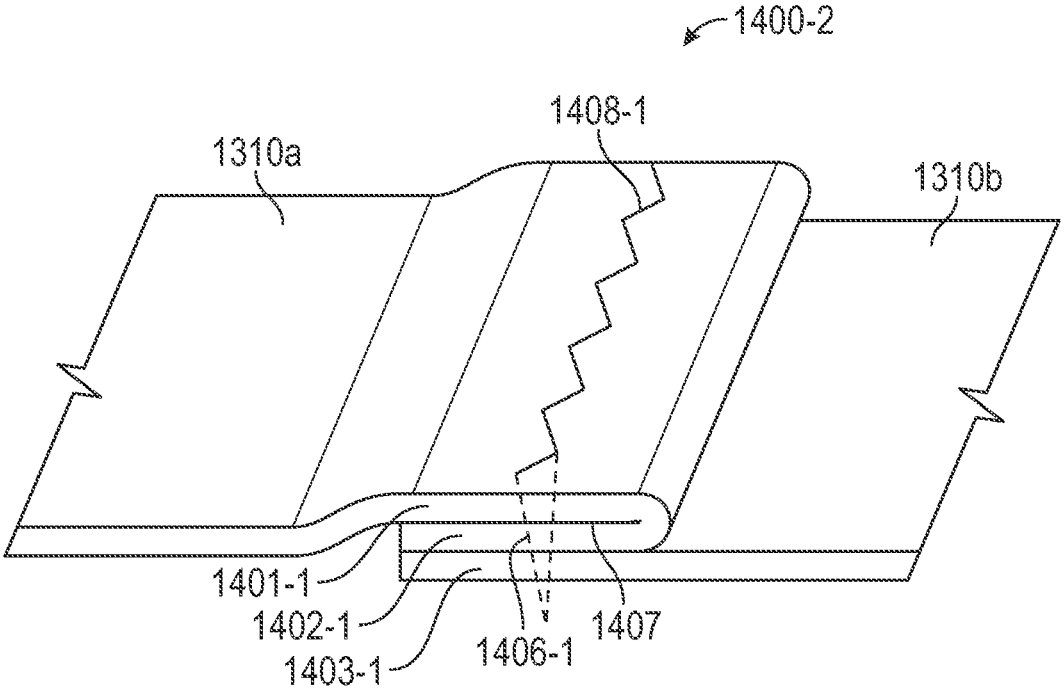
FIG. 4B illustrates an isometric view of a second embodiment of a joint section operable in the system shown in FIG. 1A and FIG. 1B.
Figure 4C:
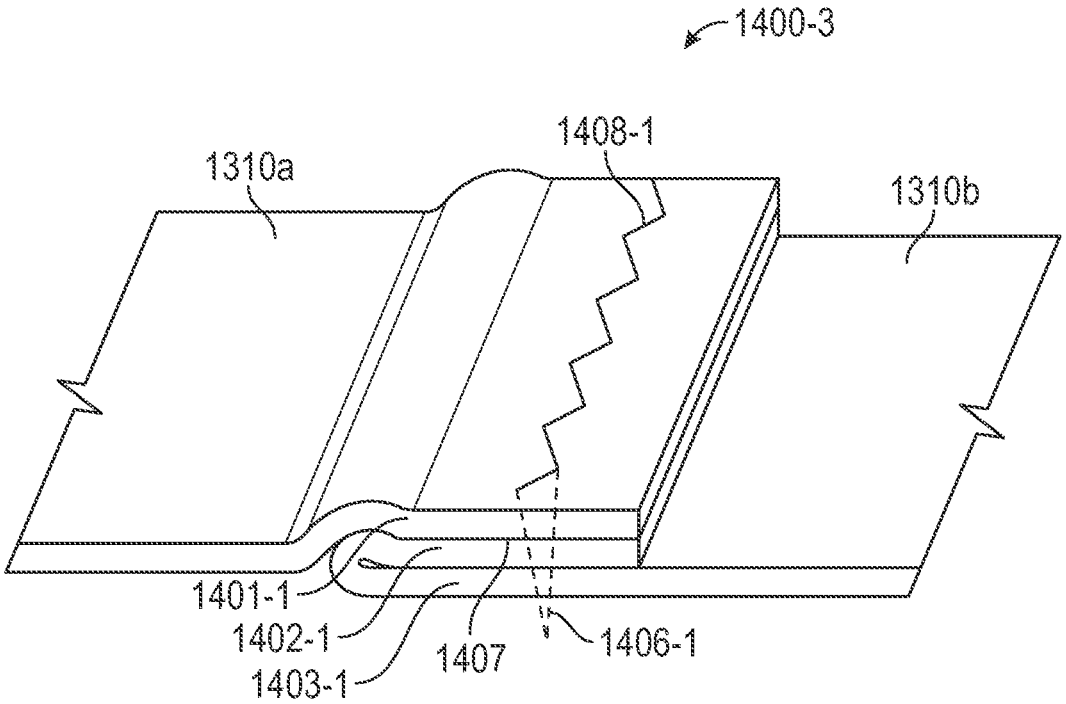
FIG. 4C illustrates an isometric view of a third embodiment of a joint section operable in the system shown in FIG. 1A and FIG. 1B.
Figure 4D:
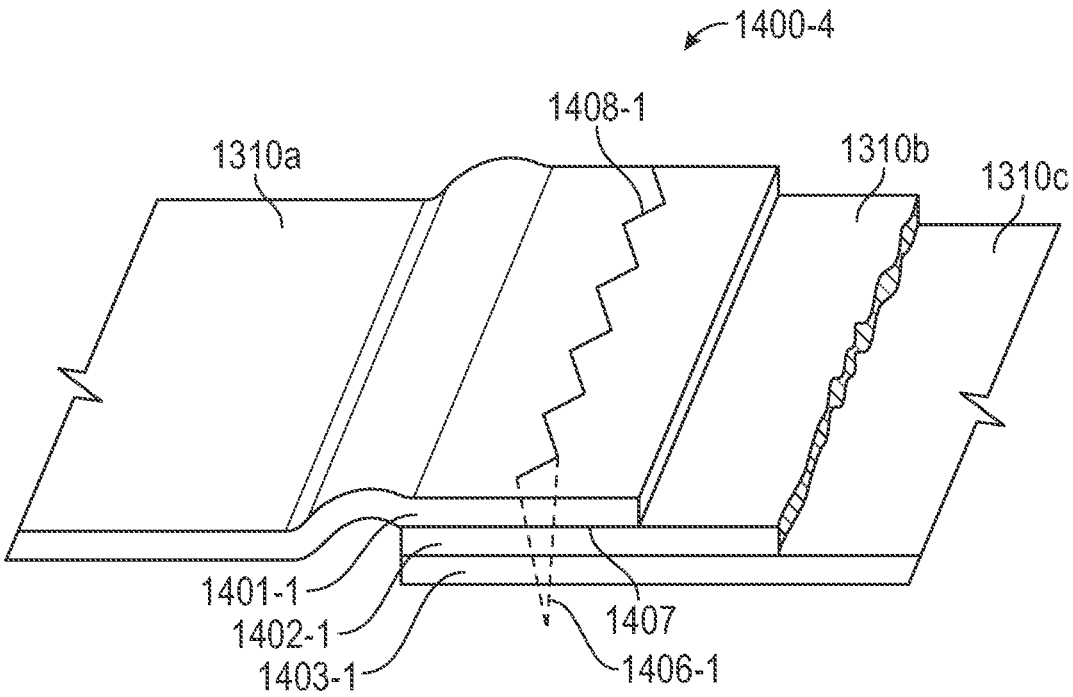
FIG. 4D illustrates an isometric view of a fourth embodiment of a joint section operable in the system shown in FIG. 1A and FIG. 1B.
Figure 4E:
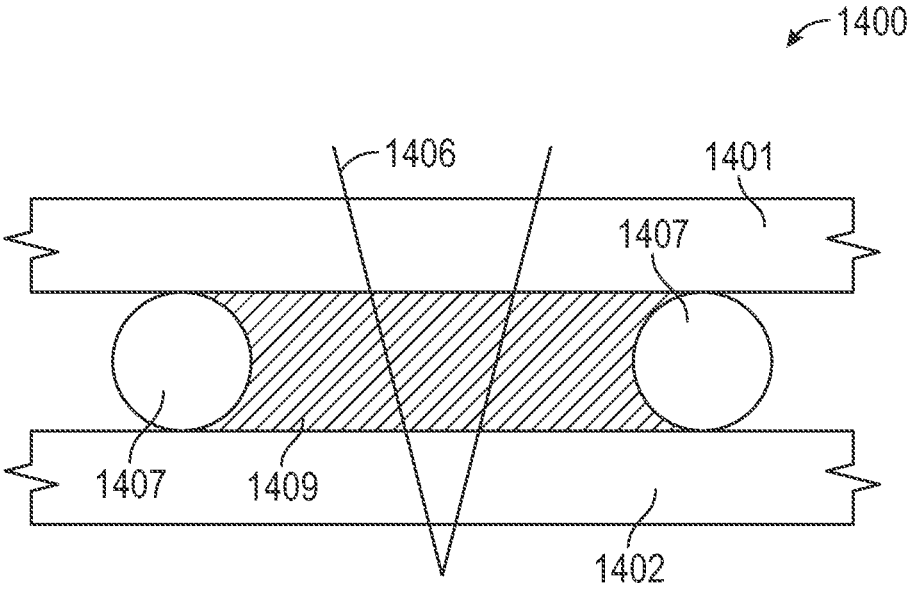
FIG. 4E illustrates a cross-sectional view applicable for at least the embodiment of the joint section shown in FIG. 4A.

Turning to FIGS. 4A-4F with continued reference to FIGS. 1A-1B, 2A-2C, 3A-3F, embodiments of joints that facilitate coupling of GCCM sections 1310 are disclosed. FIGS. 4A and 4E show an embodiment of joint 1400 in which two pieces of GCCM 1320 overlap, such as individual sections of GCCM sections 1310. For example, GCCM section 1310*a* and 1310*b* may be two sections within the plurality of GCCM sections 1310. Joint 1400 comprises a first layer 1401 and a second layer 1402. As illustrated, joint 1400 is created by overlapping GCCM 1320 from GCCM section 1310*a* and 1310*b*, where GCCM section 1310*a* provides the first layer 1401 and GCCM section 1310*b* provides the second layer 1402. The outward surface of GCCM section 1310*a* and 1310*b* may be permeable to water due to the outward surface of each respective section comprising the first surface 1321 of GCCM 1320 (which as previously discussed is a water permeable surface that allows for hydration to occur). The joint 1400 further comprises a securing element 1406 (e.g., a thread comprising synthetic and/or non-synthetic fibers, a single monofilament fiber, etc.) that is stitched in a securing pattern 1408. In some embodiments securing element 1406 may also comprise a rigid connector, such as a staple, nail, and/or screw. The securing element 1406 is configured to penetrate the first layer 1401 and second layer 1402 so as to couple the GCCM 1320 together, thereby reducing separation 1409 to facilitate a liquid and/or pneumatic seal.

In some embodiments, joint 1400 comprises one or more beads of sealant 1407 between first layer 1401 and second layer 1402. Joint 1400 may be configured such that sealant 1407 is disposed along at least one side of securing pattern 1408 and sandwiched between first layer 1401 and second layer 1402. The sealant 1407 may be applied to the outward facing surface of second layer 1402. Sealant 1407 may comprise an adhesive such that when separation 1409 is reduced, the sealant 1407 spreads between first layer 1401 and second layer 1402 so as to couple them together. In some embodiments, sealant 1407 may be water resistant and/or water impermeable so as to create a substantially waterproof or gas tight seal (i.e., preventing at least 50% of water passage between first layer 1401 and second layer 1402). The joint 1400 is configured to couple individual pieces of GCCM sections 1310 together so as to provide pneumatic inflation of IRS forms 1300, 1302. In an embodiment, joint 1400 is configured to provide a seal such that gas and/or liquid is mitigated and/or prevented from passing along separation 1409 between first layer 1401 and second layer 1402, and cannot pass from the cavity (e.g., cavity 1331, 1332) through GCCM sections 1310 themselves (i.e., liquid and/or gas cannot penetrate from the cavity, through second layer 1402 and towards the first layer 1401 due to each layer being comprised of GCCM 1320 that has second surface 1322, which may be configured to be impermeable to liquid and/or gas).

By way of example, joint 1400 may be implemented as an embodiment of foundation joints 1112 illustrated in FIGS. 2A and 2B. In the embodiment of IRS form 1300 shown in FIGS. 3A and 3B, joint 1400 may be implemented to couple a non-planar surface 1312 to a planar surface 1314 and/or to another non-planar surface 1312. Prior to hydration, joint 1400 is configured to be flexible. In some embodiments, hydration of joint 1400 includes injection of water along the securing pattern 1408 such that water passes through points of penetration from securing element 1406 so as to hydrate second layer 1402 and first layer 1401.

Figure 4F:
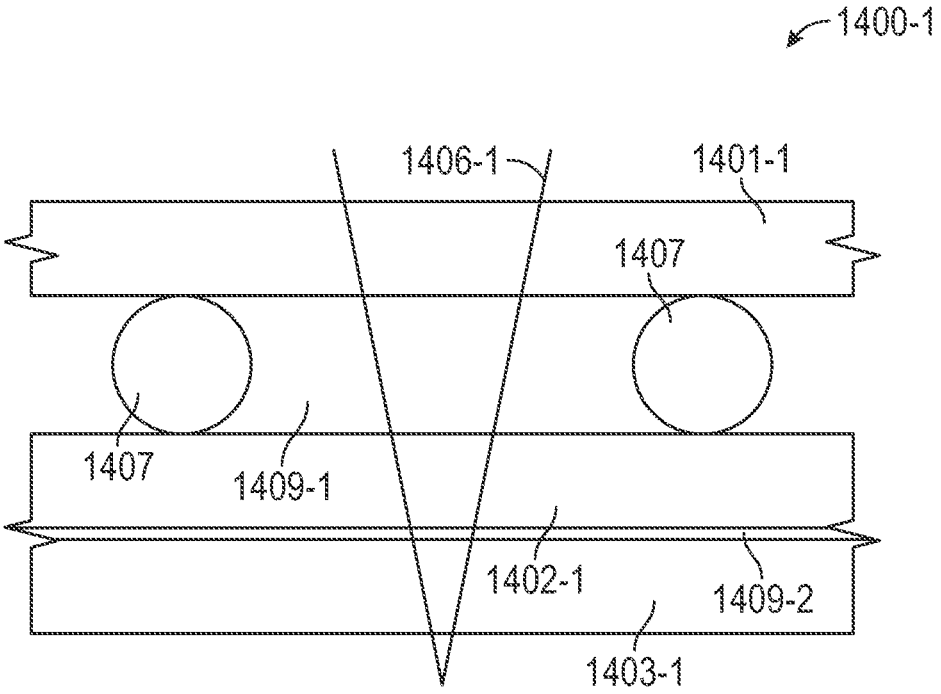
FIG. 4F illustrates a cross-sectional view applicable for at least the embodiments of the joint sections shown in FIG. 4B, FIG. 4C, and FIG. 4D according to the present disclosure.

In another embodiment, joint 1400-1 is disclosed. Joint 1400-1 may be implemented where more than two pieces of GCCM 1320 from GCCM section 1310 couple together. As illustrated in FIG. 4F, joint 1400-1 comprises a first layer 1401-1, a second layer 1402-1, and a third layer 1403-1. Each of first layer 1401-1, second layer 1402-1, and third layer 1403-1 comprises GCCM 1320 that has a first surface 1321 that facilitates hydration. Joint 1400-1 includes securing element 1406-1, which is substantially similar to securing element 1406 previously discussed with respect to joint 1400. Securing element 1406-1 penetrates each of first layer 1401-1, second layer 1402-1, and third layer 1403-1 so as to reduce separations 1409-1 and 1409-2 (which correspond with separations between the first and second layer, and second and third layer respectively) and couple each of the layers together. Joint 1400-1 may comprise one or more beads of sealant 1407, such as discussed with respect to joint 1400. In the embodiment shown in FIG. 4F, two beads of sealant 1407 are disposed on either side of securing element 1406-1 between first layer 1401-1 and second layer 1402-2, and the sealant 1407 may extend along the length of a securing pattern (e.g., securing patterns 1408-1 show in FIGS. 4B-4D). In another embodiment, sealant 1407 may be disposed between second layer 1402-1 and third layer

1403-1 within separation 1409-2. It is understood that separations 1409-1 and 1409-2 may exist prior to securing element 1406-1 being applied, and thus once securing element 1406-1 is implemented to create securing pattern 1408-1, each of separations 1409-1 and 1409-2 are reduced and/or cease to exist due to the materials touching each other. In some embodiments, the joint 1400 and 1400-1 are not hydrated prior to securing pattern 1408, 1408-1 being implemented. The joint 1400-1 is configured to provide a seal such that gas and/or liquid is mitigated and/or prevented from passing along separation 1409-1 between first layer 1401-1 and second layer 1402-1, mitigated and/or prevented from passing along separation 1409-2 between second layer 1402-1 and third layer 1403-1, and cannot pass from a cavity (e.g., cavity 1331, 1332) through GCCM sections 1310 themselves (i.e., liquid and/or gas cannot penetrate from the cavity, through third layer 1403-1 towards the second layer 1402-1 and first layer 1401-1 due to each layer being comprised of GCCM 1320 that has second surface 1322, which may be configured to be impermeable to liquid and/or gas).

FIGS. 4B-4D discloses joints 1400-2, 1400-3, and 1400-4, respectively, which are embodiments of joint 1400-1 illustrated in FIG. 4F. As shown in FIG. 4B, joint 1400-2 comprises first layer 1401-1, second layer 1402-1, and third layer 1403-1. The joint 1400-2 is created by overlapping GCCM section 1310*a* and 1310*b*, which are adjacent individual pieces of GCCM sections 1310, where each section comprises GCCM 1320. The first layer 1401-1 and second layer 1402-1 of joint 1400-2 is configured GCCM section 1310*a* being folded back onto itself, thereby forming separation 1409-1. In this embodiment, GCCM section 1310*b* provides the third layer 1403-1, which is overlapped below GCCM section 1310*a*, thereby forming separation 1409-2. Sealant 1407 may be applied to separation 1409-1 prior to GCCM section 1310*a* being folded back onto itself, and sealant 1407 may be applied to separation 1409-2 to couple GCCM sections 1310*a* and 1310*b*. With GCCM section 1310*a* folded back onto itself to provide layer 1401-1 and second layer 1402-1, and each of these layers overlapping 1310*b* that provides third layer 1403-1, securing element 1406-1 may penetrate each of the layers 1401-1 through 1403-1 and is sewn along the length of joint 1400-2 to create sewing pattern 1408-1.

As shown in FIG. 4C, joint 1400-3 is created by overlapping GCCM sections 1310*a* and 1310*b*, which are adjacent individual pieces of GCCM sections 1310, where each section comprises GCCM 1320. Joint 1400-3 comprises first layer 1401-1, second layer 1402-1, and third layer 1403-1, where first layer 1401-1 is provided by GCCM section 1310*a*, and the second layer 1402-1 and third layer 1403-1 are provided by GCCM section 1310*b* being folded onto itself. Each of the three layers are secured with securing element 1406-1 and one or more beads of sealant 1407. Securing element 1406-1 penetrates each of the layers 1401-1 through 1403-1 and extends along the length of joint 1400-3, thereby creating sewing pattern 1408-1.

As shown in FIG. 4D, joint 1400-4 is created by overlapping three adjacent pieces of GCCM sections, such as GCCM sections 1310*a*, 1310*b*, and 1310*c*. For example, as shown in the embodiment of FIG. 3A, joint 1400-4 is implemented to couple GCCM sections 1310*a*, 1310*b*, and 1310*c* together. Joint 1400-4 comprises first layer 1401-1, second layer 1402-1, and third layer 1403-1, where first layer 1401-1 is provided by GCCM section 1310*a*, the second layer 1402-1 is provided by GCMIVI section 1310*b*, and the third layer 1403-1 is provided by GCCM section 1310*c*. Each of the three layers are secured with securing element 1406-1 and one or more beads of sealant 1407. Securing element 1406-1 penetrates each of the layers 1401-1 through 1403-1 and extends along the length of joint 1400-4, thereby creating sewing pattern 1408-1. In some embodiments of joints 1400 and 1400-1, the layers 1401, 1402, and 1401-1 through 1403-1 may be referred to as joint layers.

Figure 5A:
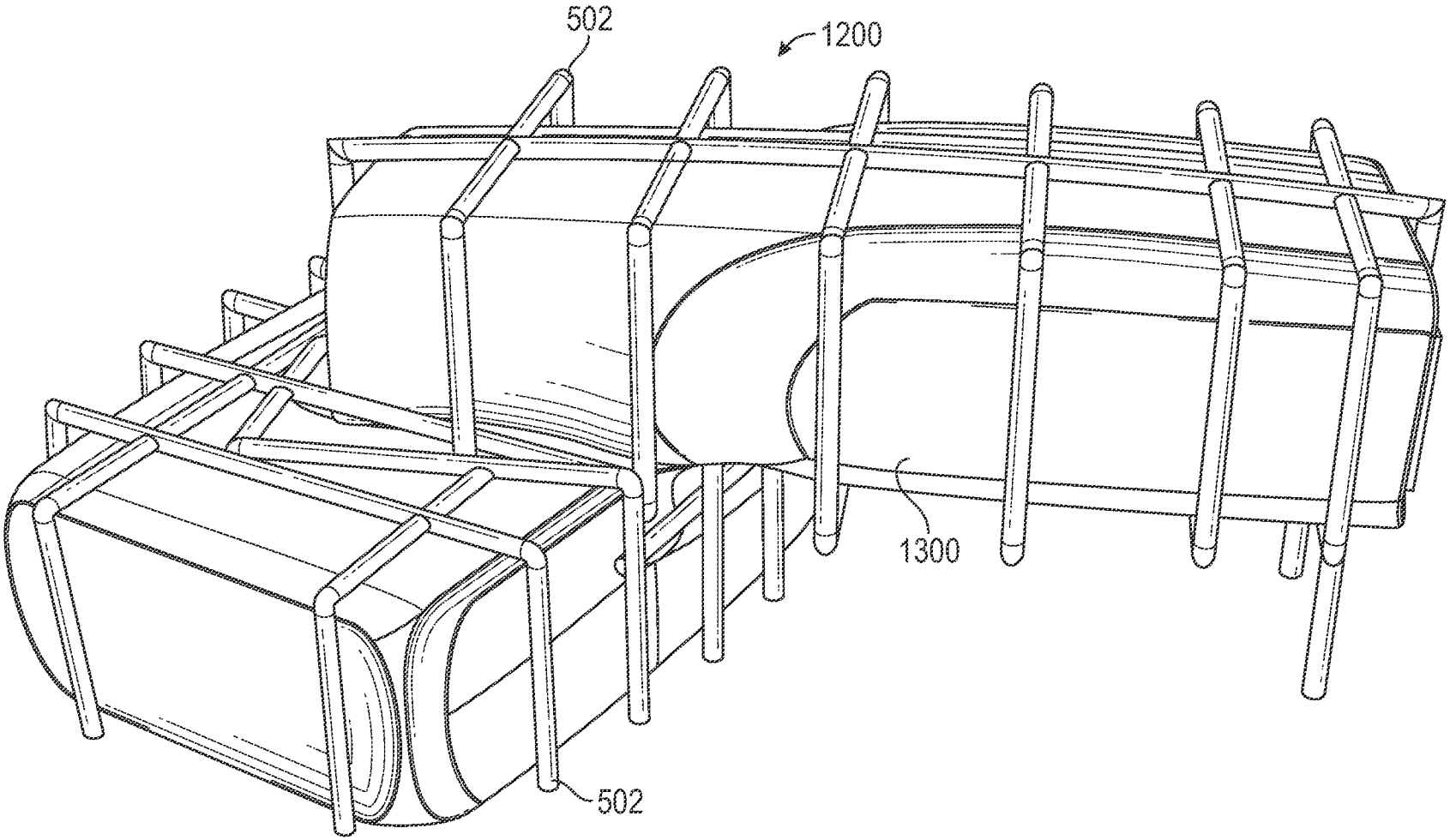
FIG. 5A illustrates an isometric view of a support structure comprising an air beam according to an embodiment.

As described herein, the support structure 1200 can serve to support the IRS form 1300 during inflation. The support structure 1200 can be a separate structure from the IRS form 1300 that can then be integrated with the inflated IRS form 1300 or removed, in whole or only portions thereof. In some embodiments, one or more portions of the support structure 1200 can comprise an air beam. As shown in FIG. 5A, an air beam 502 can refer to any closed structure that can be inflated to provide a structural element. In the simplest form, the air beam 502 can comprise a tube of relatively air tight material that can be inflated, and upon inflation, can provide a structural element (e.g., due to hoop stresses within the inflated structure). As an example, one or more tubes can be inflated to form an exoskeleton that can support or shape the IRS form 1300 upon inflation.

Air beams 502 can comprise one or more inflatable structures. While described as a closed tube, the air beams can take a variety of forms. As with the IRS form 1300, the air beams 502 can be constructed of one or more portions of material that allows for their final shape to be predetermined when inflated to the design pressure. The air beams 502 may be separated inflatable from the IRS form 1300 in order to reach a predetermined pressure. In some embodiments, the air beams 502 may be inflated to a higher pressure than the IRS form 1300 in order to provide the structural support for the IRS form 1300 during inflation.

The material used to form the air beams may depend on their final use. For air beams 502 that are part of a removable support structure, the air beams 502 may be formed from a structural fabric or material that is capable of being inflated to pressure suitable for providing the desired structural support while also being capable of holding the inflation pressure. For example, an internal bladder type material can be surrounded with a structural layer to form a multilayer inflatable air beam 502. When the air beams 502 are integrated into the final structure, all or a portion of the air beams 502 may be formed from the GCCM material 1320. Upon hydration, the GCCM material 1320 in the air beams 502 that are in contact with the GCCM material 1320 in the IRS form 1300 may fuse or join to form an integrated structure. When joined together, it is expected that the air beams 502 can rigidize and provide structural support 1200 for the final form.

When used, air beams 502 can form a part of a separate support structure, integrated into the IRS form 1300, or be used in a combination of both separate air beam structures and integrated air beams 502 within the IRS form 1300. When the air beams are separate, they may form a part of the support structure in the same way the support structure is described herein with respect to FIGS. 1A-1B. For example, FIG. 5A illustrates an example of a support structure 1200 formed from a plurality of air beams 502, where the air beams 502 effectively replace the structural elements in the support structure 1200. Any of the structural elements can then be replaced with air beams 502, and the air beams can be used with the final structure as described with respect to the support structure 1200 (e.g., integrated into the final structure, removed in whole or in part, etc.) as described herein. The use of air beams 502 for all or a portion of the support structure may provide for an easily transportable structure that can inflated on site while being used to help for the final IRS form 1300. Since the air beams 502 can be constructed to assume a predetermined form, the ability to inflate the air beams to assume the final form may provide savings in terms of transportation space and the time needed to set up the support structure 1200 prior to inflating the IRS form 1300.

Figure 5B:
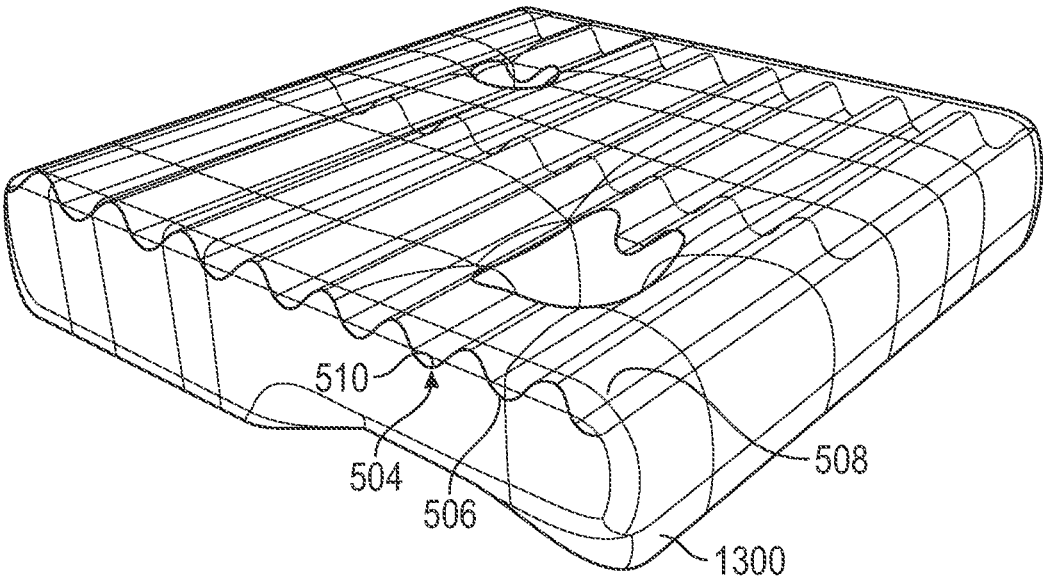
FIG. 5B illustrates an isometric view of an air beam integrated into an IRS form according to an embodiment.

In some embodiments, the air beams can be integrated into the IRS form 1300. As shown in FIG. 5B, an integrated air beam 504 can comprise one or more layers of material 506 coupled to a layer 508 of the IRS form 1300 in order to form a pocket or chamber 510 between the material 506 and the layer 508 of the IRS form 1300. Through the use of an appropriate connection pattern, a plurality of air beams can be formed across a surface. For example, a plurality of air beams can be used to provide support for and form a ceiling or floor section of the final structure. As described in more detail herein, one or more integrated air beams 504 can also be used in side walls to provide structural support to the final building, for example, when the integrated air beams 504 are rigidizable. The air beams 504 can be separately inflatable from the IRS form 1300 using similar connections and controls (e.g., the use of one valve, two valves, etc.) as described herein with respect to the IRS form 1300.

The integrated air beam 504 can have a number of forms including cylindrical, "Z" shape, "L" shape, "C" shape or other shape, where the shape may be determined based on structural load considerations. The air beams 504 can extend across all or a portion of a surface as needed for structural considerations. While shown as forming a flat or planar surface in FIG. 5B, the air beams 504 can also be used for form a non-planar surface, such as a sloped or rounded roof. Since the air beams 504 can be integrated to form a final determinable shape, the use of the air beams 504 to form part of the final structure allows the integrated air beams 504 to be used in forming the IRS form 1300 as well as the final structural shape.

The integrated air beams 504 can be formed from GCCM sections 1310 such that the material 506 can be rigidizable along with the IRS form 1300. In this embodiment, the shape of the integrated air beams 504 can be used to provide structural support as well as other construction aspects in the final form. For example, the rigidized air beams can form a structural beam in the final structure. In addition, the channels formed by the integrated air beams 504 may be used for various aspects such as electrical, plumbing, or ducting runs once the structure has been fully rigidized.

Figure 5C:
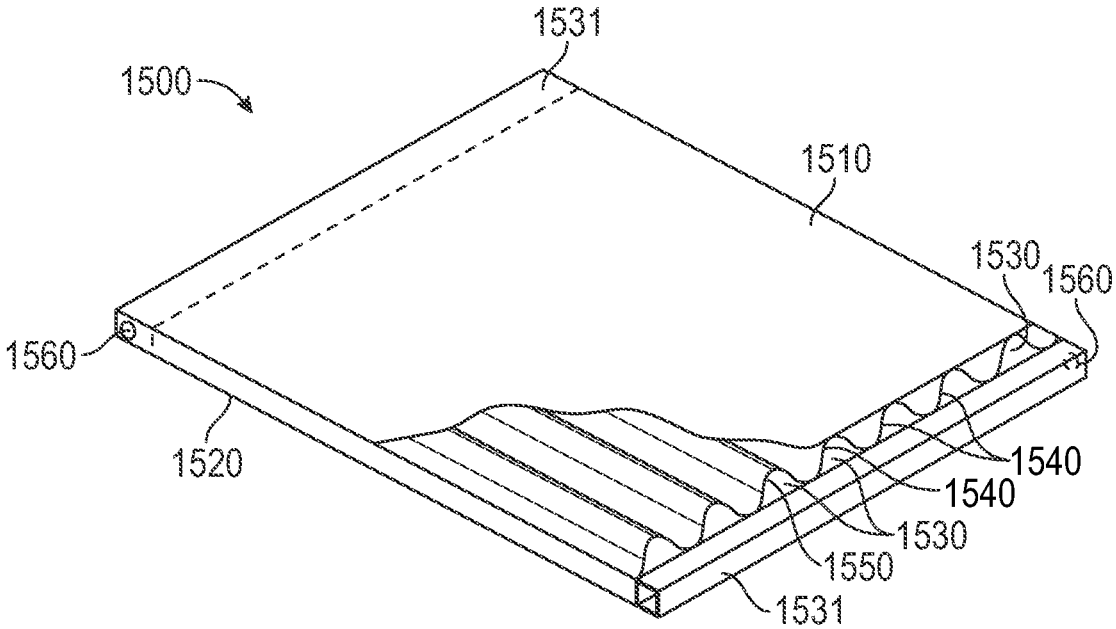
FIG. 5C illustrates an isometric view of an air beam according to an embodiment of the present disclosure.

As shown in FIGS. 5C-5G, additional embodiments of integrated air beams integrated into the IRS form 1300 are shown. It is understood that the shape of air beam 1500 is not limited to a rectangle as illustrated in FIG. 5C, but other embodiments may include air beam 1500 being configured according to the shape of the GCCM sections 1310 and may include, but is not limited to, cylindrical, "Z" shape, "L" shape, "C" shape or other shape. The air beam 1500 is operable to facilitate creation of a cementitious building (which is accomplished via inflation of IRS form 1300 and hydration of its GCCM section 1310). In some embodiments, the air beam can be formed as described above and coupled to the IRS form 1300, and/or one or more GCCM sections 1310 may comprise an air beam 1500, such as by creating joints (e.g., 1400, 1400-1) using edges of air beam 1500 and its adjacent GCCM sections.

In an embodiment, the air beam 1500 comprises a first layer 1510 of GCCM 1320, a second layer 1520 of GCCM 1320, and a plurality of connectors 1550 used to create channels. The connectors 1550 are disposed between the first layer 1510 and the second layer 1520 so as to define an air beam cavity 1530. For example, one or more air beam cavities 1530 are defined between a first surface 1551 of connector 1550, which can optionally be rigidizable, and first layer 1510. Additional air beam cavities 1530 are defined between second surface 1552 of connector 1550 and second layer 1520. The air beam 1500 comprises securing elements 1570, which are substantially similar to securing elements 1406 discussed with respect to joint 1400. For example, securing elements 1570 may comprise thread that is used to secure (e.g., via sewing pattern 1580) each rigidizable connector 1550 to first layer 1510 and/or second layer 1520.

A connector 1550 can be configured to rigidize in response to introduction of water within an air beam cavity 1530. This may occur due to at least one of the first surface 1551 or second surface 1552 of connector 1550 being configured with the liquid permeable surface 1321 of GCCM 1320. As such, when air cavities 1530 are inflated and hydration occurs (i.e., water is introduced within air cavities 1530), at least one connector 1550 can begin to harden (i.e., rigidize). The inward surface of first layer 1510 and/or second layer 1520 (i.e., the first layer's surface or second layer's surface that faces inward towards the air cavity 1530) may be configured with the liquid permeable surface 1321 of GCCM 1320, and thus when liquid is introduced into air cavities 1530, at least one of the first layer 1510 or second layer 1520 will also being to harden (i.e., rigidize). When only one of the first layer 1510 or second layer 1520 has liquid permeable surface 1321 of GCCM 1320 facing inwards towards an air cavity 1530, the introduction of water within the air beam cavity 1530 does not cause the other layer (i.e., the layer that does not have liquid permeable surface 1321 facing inwards towards air cavity 1530) to rigidize (i.e., harden). This may be because the other layer has surface 1322 facing inwards towards the cavity 1530, where surface 1322 is configured to be impermeable to water. As such, this other layer must be hydrated externally.

The air beam cavities 1530 expand in response to pneumatic inflation via valve 1560. As illustrated, air beam 1500 may comprise one or more valves that facilitate pneumatic inflation and/or introduction of water within the air beam cavities 1530. In an embodiment, air beam 1500 comprises two valves 1560, where one is configured for inflation, and one is configured for pressure regulation and/or gas and/or liquid release. The air beam 1500 may define a channel 1531 that extends perpendicular to air beam cavities 1530 and is in fluid communication with each cavity 1530. The channel 1531 is configured to allow for introduction of gas and/or liquid along the width of the air beam 1500 so that gas and/or liquid may be introduced into each of the cavities 1530. Thus, valve 1560 is configured to facilitate pneumatic inflation of air beam cavity 1530, hydration of at least one connector 1550, or a combination thereof. In an embodiment, the connectors 1550 of air beam 1500 are disposed between first layer 1510 and second layer 1520 in a non-arcuate array 1540, such as shown in FIG. 5C. In an embodiment, the connectors 1550 of air beam 1500 are disposed between first layer 1510 and second layer 1520 in an arcuate array 1541, such as shown in FIG. 5E. In the embodiment shown in FIGS. 5A-5C, the plurality of connectors 1550 are configured in the shape of a wave due to alternating points of attachment with securing element 1570. When the connectors 1550 are rigidizable, the hardening of the connectors and the GCCM material 1320 may provide a rigid material in which the connectors 1550 serve as structural elements 1200. The air beam 1500 may then provide structural support when inflated and during hydration while also providing continued structural support in the final structure.

Figure 5D:
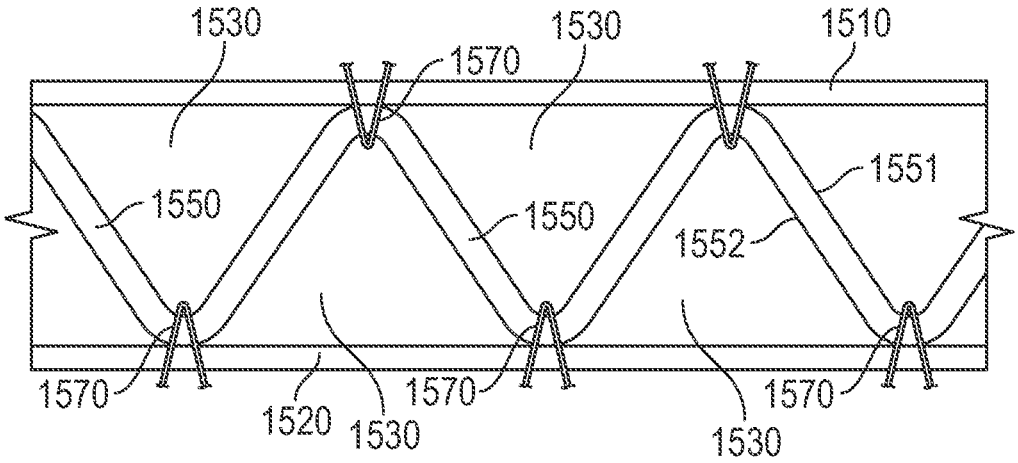
FIG. 5D illustrates a cross-sectional view of the air beam shown in FIG. 5A.
Figure 5E:
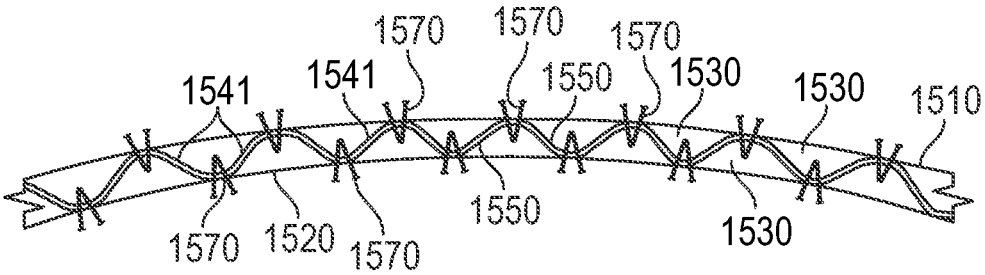
FIG. 5E illustrates a cross-sectional view of an embodiment of the air beam shown in FIG. 5A and FIG. 5B.
Figure 5F:
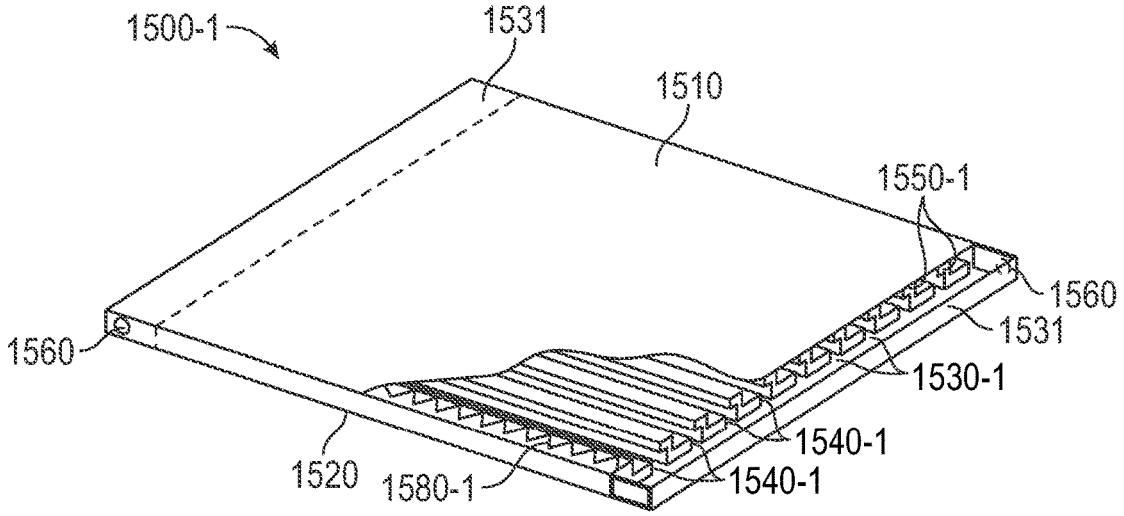
FIG. 5F illustrates an isometric view of an air beam according to another embodiment of the present disclosure.
Figure 5G:
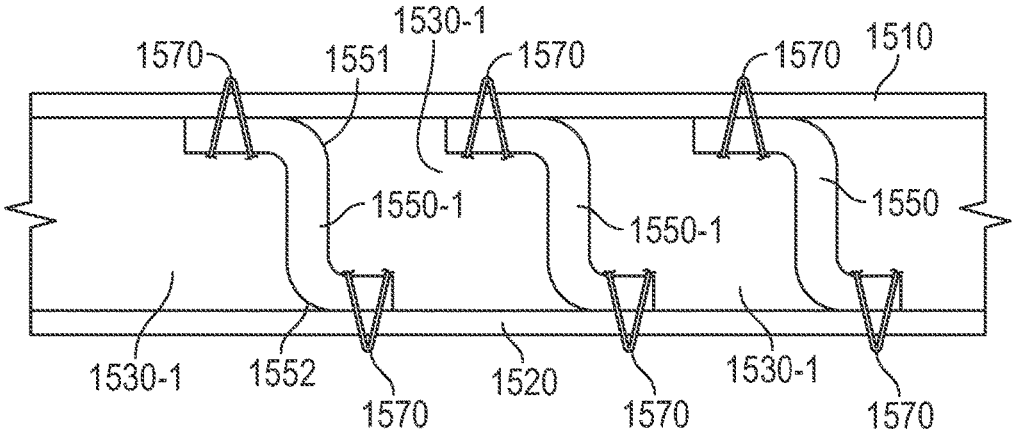
FIG. 5G illustrates a cross-sectional view of the air beam shown in FIG. 5D.
Figure 5H:
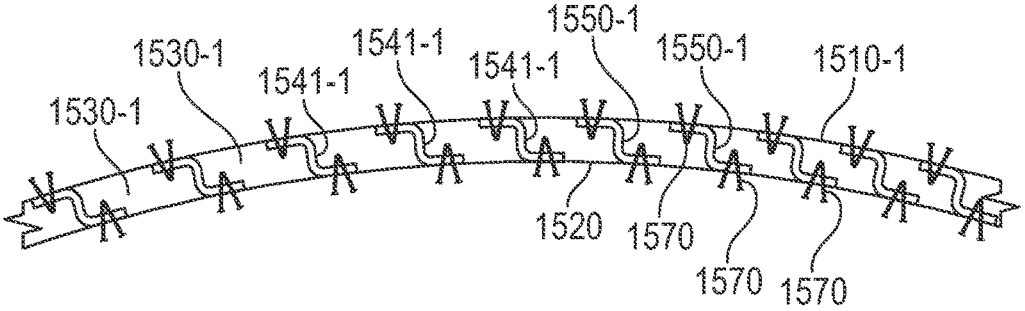
FIG. 5H illustrates a cross-sectional view of an embodiment of the air beam shown in FIG. 5E and FIG. 5F.

In another embodiment, air beam 1500-1 is disclosed and illustrated in FIGS. 5D-5F. Air beam 1500-1 may be substantially similar to the embodiment of air beam 1500. In this embodiment, air beam 1500-1 comprises a first layer 1510 of GCCM 1320, a second layer 1520 of GCCM 1320, and a plurality of connectors 1550-1, which can optionally be rigidizable. The connectors 1550-1 can be disposed between the first layer 1510 and the second layer 1520 so as to define an air beam cavity 1530-1. The connectors 1550-1 are substantially similar to the connectors 1550, however, connectors 1550-1 may be configured in the shape of a "Z" and define a more rectangular shape for air beam cavities 1530-1. The connectors 1550-1 are coupled to first layer 1510 and second layer 1520 via securing elements 1570. The securing elements 1570 are sewn along the length of each connector 1550-1 so as to create sewing pattern 1580-1. The connectors 1550 comprise a first surface 1551 and second surface 1552, and at least one of the first surface 1551 or second surface 1552 is configured as the liquid permeable surface 1321 of GCCM 1320. Each of the first layer 1510, second layer 1520, and connectors 1550-1 comprise GCCM 1320. The air beam 1550-1 may comprise channel 1531 that provide fluid communication to and from the valve(s) 1560 so as to facilitate pneumatic inflation (via introduction of gas) and/or hydration (via introduction of liquid) along each air beam cavity 1530-1. Similar to air beam 1500, the air beam 1500-1 can be configured to rigidize in response to hydration. For example, first layer 1510 may be configured to rigidize in response to receiving hydration on the external surface of the air beam 1500-1, while connectors 1550-1 and second layer 1520 may be configured to rigidize in response to hydration via injection of water via valve and within air beam cavities 1530-1. In an embodiment, the connectors 1550-1 of air beam 1500-1 are disposed between first layer 1510 and second layer 1520 in a non-arcuate array 1540-1, such as shown in FIG. 5F. In an embodiment, the connectors 1550-1 of air beam 1500-1 are disposed between first layer 1510 and second layer 1520 in an arcuate array 1541-1, such as shown in FIG. 5H. In the embodiment shown in FIGS. 5D-5F, the plurality of connectors 1550-1 are not connected to each other and are each configured in the shape of a "Z" due to points of attachment with securing element 1570.

Figure 6A:
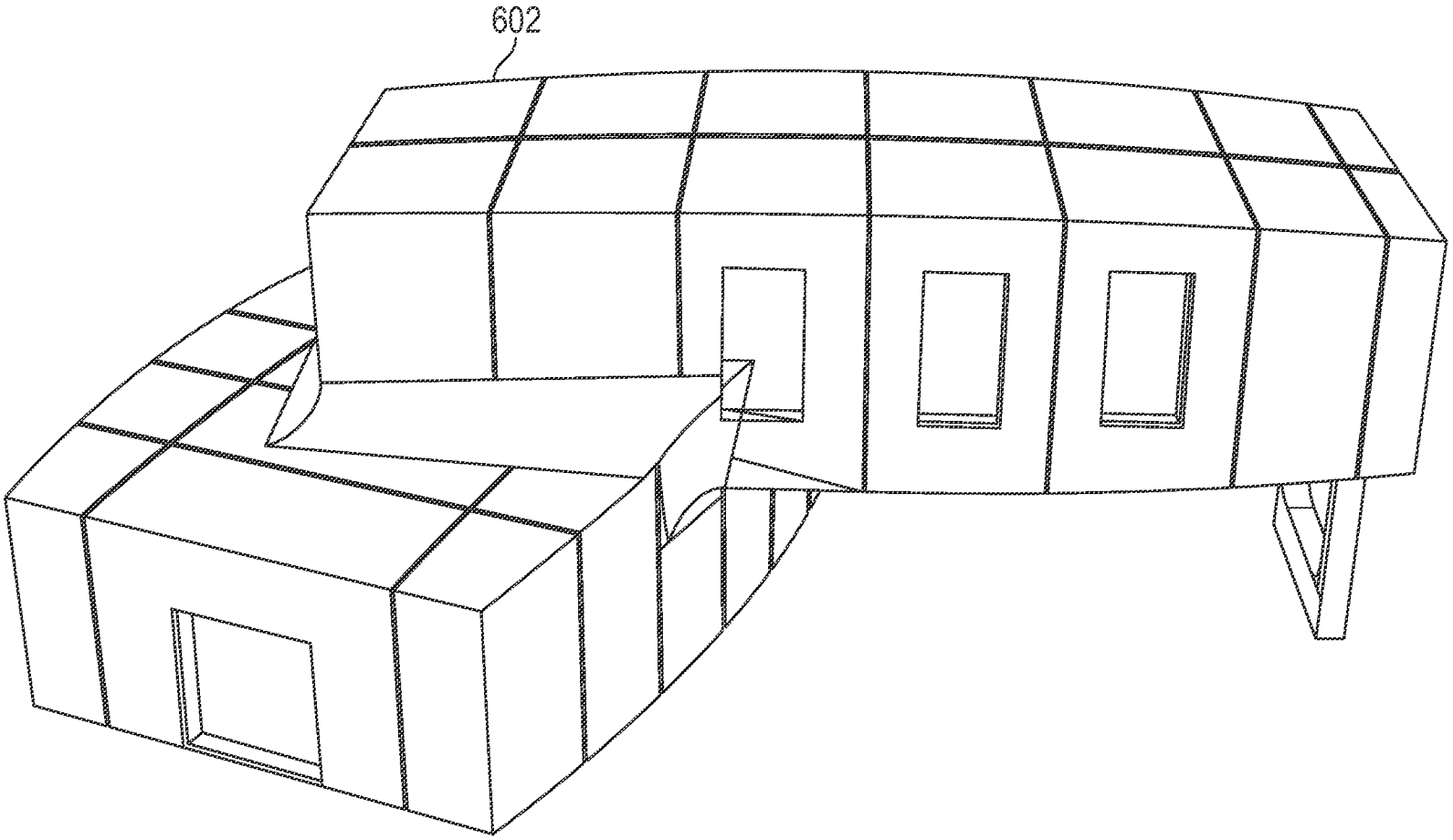
FIG. 6A illustrates an isometric view of a final structure having an exterior layer disposed thereon according to an embodiment.
Figure 6B:
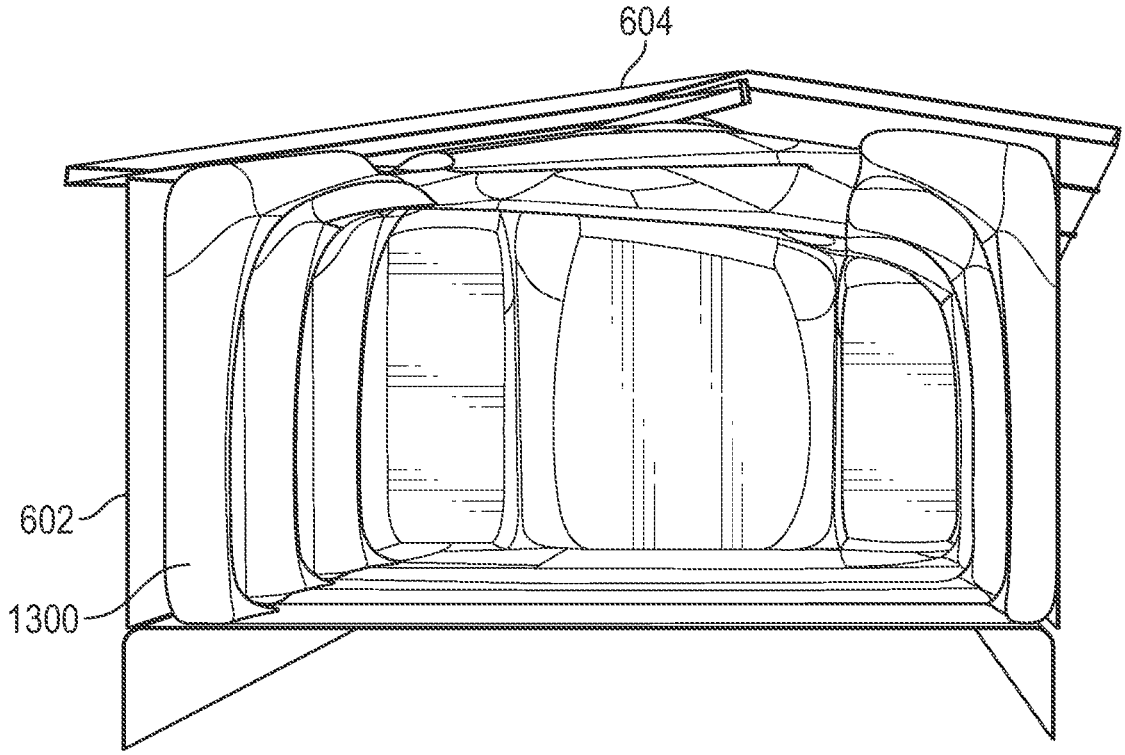
FIG. 6B illustrates a partial cross-section of a final structure according to an embodiment.

Once the structure has been fully rigidized, an outer skin or layer can optionally be provided to the structure to provide the final finish to the structure. As shown in FIGS. 6A-6B, a final layer 602 can be applied to the final rigidized form. In some embodiments, the support structure (e.g., using structural elements, air beams, etc.) can be left in contact with the rigidized IRS form 1300. The support structure 1200 can then form a portion of the structure to allow the exterior layer 602 to be attached. For example, an exterior finish comprising siding, bricks, stone, shingles, or any other exterior finish material can be connected to the rigidized IRS form 1300 and/or the support structure 1200. The final layer 602 can also comprise a roof 604 or other cover structure. When the exterior layer 602 is attached to the support structure 1200, a space between the exterior layer 602 and the rigidized IRS form 1300 can be used for providing insulation or other utility (e.g., electrical, plumbing, venting, etc.) or structural elements.

The resulting cross section of the final structure can then be provided as shown in an example presented in FIG. 6B. As shown, the IRS form 1300 can be inflated and rigidized to assume the final structural shape. As shown in FIG. 6B, integrated air beams can be included in the walls, floor, and ceiling to provide structural support. The exterior layer 602 can then be added to the exterior of the rigidized IRS form 1300 to provide a finish to the structure, and a roof 604 can also be provided for weather proofing the final structure.

The present disclosure includes methods of creating a cementitious building via inflation and hydration, such as from any one of IRS forms 1300, 1302 of FIGS. 1-4 and/or air beams 502, 1500 of FIG. 5A-5H. In some embodiments, a foundation 1100 adapted to support a support structure 1200 can be formed or provided. The support structure 1200 comprises a plurality of support members 1210, and the plurality of support members 1210 of the support structure 1200 are configured to provide a framework over the foundation 1100. Depending on the type of installation, a foundation 1100 may not be used or a pre-existing foundation may already exist. At least one of the plurality of support members 1210 of the support structure 1200 can be anchored to at least a portion of the foundation 1100. In some embodiments, the plurality of support members 1210 comprise at least one of: a rigid beam, a rigid beam wrapped with GCCM 1320, or a combination thereof. In some embodiments, all or a portion of the support structure 1200 can be formed using one or more air beams 502, 1500.

An IRS form 1300 can then be provided. The IRS form 1300 comprises a plurality of GCCM material sections 1310, and each GCCM section 1310 can be coupled to another GCCM section 1310 of the plurality such that the IRS form 1300 is pneumatically inflatable to form a predetermined structural form. The GCCM sections 1310 can be configured to provide non-planar interfaces 1312 for transitioning between planar surfaces 1314 of the IRS form 1300 in response to pneumatic inflation. The IRS form 1300 can be aligned on the foundation 1100 such that the framework restrains the IRS form 1300 in response to inflation. This allows for non-rounded forms to be created during inflation and prior to hydration.

The IRS form 1300 can be pneumatically inflated. Pneumatically inflating the IRS form 1300 may optionally include applying a gas directly to an interior surface of the plurality of GCCM sections 1310 without using a separate inflatable bladder inside the IRS form 1300. The IRS form 1300 may comprise a valve 1360 that is configured to facilitate pneumatic inflation. Optionally, at least one of the plurality of GCCM sections 1310 of the IRS form 1300 includes an air beam 501, 1500, the air beam 502, 1500 comprising a first layer 1510, a second layer 1520, and a plurality of connectors 1550 disposed between the first layer 1510 and the second layer 1520. Optionally, each of the plurality of rigidizable connectors 1550 can be disposed between the first layer 1510 and the second layer 1520 in one or more of an arcuate array 1541, a non-arcuate array 1540, or a combination thereof. Optionally, each of the rigidizable connectors 1550 are configured between the first layer 1510 and the second layer 1520 so as to define an air beam cavity 1350 between each of the rigidizable connectors 1550.

Each of the plurality of GCCM sections 1310 of the IRS form 1300 can then be hydrated while maintaining pneumatic inflation, where each of the GCCM sections 1310 comprises a GCCM 1320 that is configured to rigidize in response to hydrating. Hydrating may include applying water to at least a portion of each of the plurality of GCCM sections 1310, thereby triggering the GCCM 1320 embedded within the plurality of GCCM sections 1310 to cure and rigidize. The pneumatic inflation can be maintained at least until some of the GCCM sections 1310 rigidize based on the hydrating.

In an embodiment, A second IRS form 1302 having a second plurality of GCCM sections 1310 that are configured to define a second cavity 1332 can optionally be provided, where the second IRS form 1302 is coupled to the IRS form 1300 such that the second cavity 1332 of the second IRS form 1302 adapted to be in fluid communication with a first cavity 1331 of the IRS form 1300. The second IRS form 1302 can be pneumatically inflated, and then hydrated such that each of the second plurality of GCCM sections 1310 of the second IRS form 1302 are hydrated while maintaining the pneumatic inflation. In some embodiments, the second plurality of GCCM sections 1310 can form a portion of the overall IRS form 1300. Optionally, each of the second plurality of GCCM sections 1310 comprises a GCCM 1320 that is configured to rigidize in response to hydrating. The pneumatic inflation of the second IRS form 1302 can be maintained until at least some of the second plurality of GCCM sections 1310 rigidize based on hydrating the second plurality of GCCM sections 1310. Optionally, inflation of each of the IRS form 1300 and the second IRS form 1302 may be maintained until each of the first plurality of GCCM sections 1310 and the second plurality of GCCM sections 1310 rigidize based on hydrating.

In some embodiments, an IRS form 1300 can be provided that comprises a plurality of GCCM sections 1310, and at least one of the plurality of GCCM sections 1310 can comprise an air beam 502, 1500. The air beam 502, 1500 may comprise a first layer 1510 and a second layer 1520, and optionally, a plurality of connectors 1550 disposed between the first layer 1510 and the second layer 1520. Optionally, at least some of the plurality of connectors 1550 can be disposed between the first layer 1510 and the second layer 1520 in one or more of an arcuate array 1541, a non-arcuate array 1540, or a combination thereof. Each of the connectors 1550 may be configured between the first layer 1510 and the second layer 1520 so as to define an air beam cavity 1530 between each of the connectors 1550.

The IRS form 1300 can then be pneumatically inflated without using a separate inflatable bladder inside the IRS form 1300. Each of the plurality of GCCM sections 1310 of the IRS form 1300 can then be hydrated while maintaining the pneumatic inflation, where each of the GCCM sections 1310 comprises a GCCM 1320 that is configured to rigidize in response to the hydrating. Optionally, hydrating can include introducing water within the air beam 502, 1500 such that hydration of the connectors 1550 occurs between the first layer 1510 and the second layer 1520 and along each air beam cavity 1530 when the connectors 1550 are rigidizable. Subsequent to hydrating, the pneumatic inflation can be maintained until at least some of the GCCM sections 1310 rigidize based on the hydrating.

The present disclosure includes a system 1000 for providing an IRS form 1300 to facilitate construction of a cementitious building via inflation and hydration, such as for providing the IRS forms 1300, 1302 of FIGS. 1-4 and/or air beams 502, 1500 of FIG. 5A-5H via the use of a computer system with features discussed in further detail with respect to FIGS. 6A, 6B, and 7. The computer system or systems can perform a number of functions including forming the GCCM sections 1310 that can then be connected together. Initially, the computer system may receive a desired final form or design for the structure. The system may then determine a plurality of GCCM sections 1310 that can be segmented in order to be connected together to form the IRS form 1300. The system may accept the available form factor for the GCCM material 1320 as an input and create the individual pieces and patterns using this as a constraint. For example, if the GCCM material 1320 is available in rolls that have a predefined width, the system may determine the individual pieces and shapes to all have a maximum width matching the predefined width. As part of determining the segmentation, the system may break down curvilinear shapes into a plurality of sections of a flat shape, that when coupled together form the desired 3-dimensional shape. For example, the segmented portions of GCCM material 1320 as described herein, each of which can be flat, can be coupled (e.g., sewn, attached, etc.) together to create a form that when inflated forms a 3-dimensional shape. The system can then send instructions to an output device to provide the patterned pieces needed to create the IRS form 1300. For example, a computer numeric control (CNC) machine may be used to automatically cut the GCCM sections 1310 for use in forming the IRS form 1300, and the system may send the instructions to the CNC machine to create the sections as determined by the system.

While the GCCM sections 1310 can be coupled by hand or on site, the system may also comprise a computer system communicatively coupled to an automated sewing machine. The computer system comprises a processor communicatively coupled to a non-transitory memory storing an application that configures the processor upon execution such that the computer system receives input of three dimensional coordinates defining a plurality of material sections to create the IRS form 1300. The computer system is also configured such that it detects a transition in orientation between two of the plurality of material sections based on the three dimensional coordinates, and determines that the transition corresponds with material sections forming one or more of a non-planar surface, an oblique angle, a right angle, or a combination thereof. The computer system pulls, from non-transitory memory based on the determined transition, a securing pattern for physically coupling material sections together, and prepares the securing pattern in a message for a computer that controls the automated sewing machine. The computer system sends the message comprising the securing pattern to initiate automatic sewing, by the sewing machine, of the material sections based on the securing pattern. Optionally, each of the material sections comprise GCCM 1320. The securing pattern may be one of a plurality of securing patterns stored in non-transitory memory. Optionally, the computer system generates instructions based on the securing pattern for execution by the automated sewing machine.

Figure 7A:
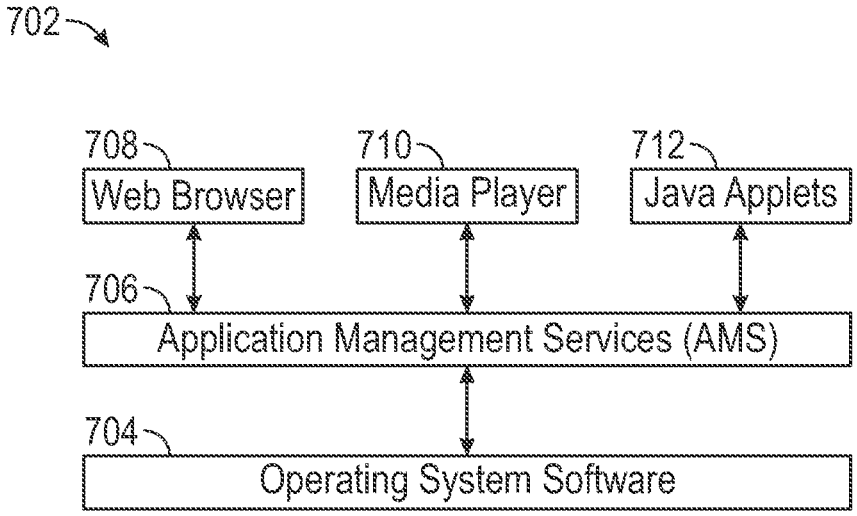
FIG. 7A is a block diagram of a software architecture of a computer system according to an embodiment of the disclosure.
Figure 8:
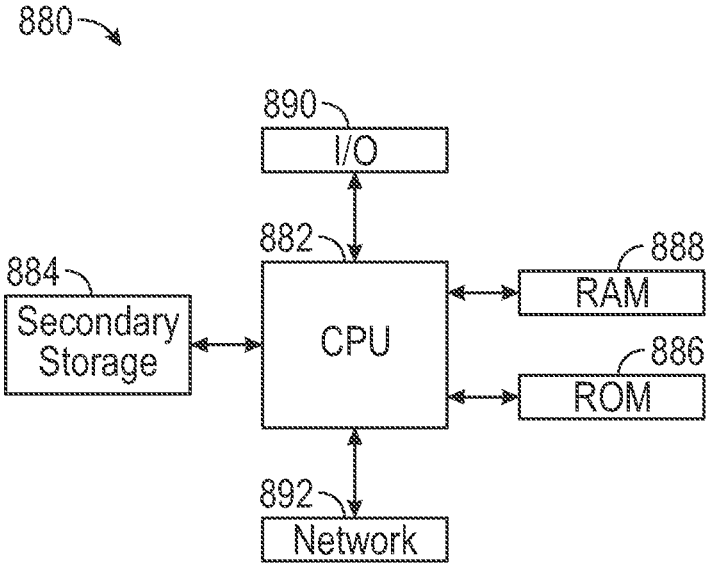
FIG. 8 illustrates a computer system suitable for implementing the several embodiments of the disclosure.

FIG. 7A illustrates a software environment 702 that may be implemented by a digital signal processor, such as CPU 882 of FIG. 8. The CPU 882 executes operating system software 704 that provides a platform from which the rest of the software operates. The operating system software 704 may provide a variety of drivers for the hardware with standardized interfaces that are accessible to application software. The operating system software 704 may be coupled to and interact with application management services (AMS) 706 that transfer control between applications running on the computer system 880 of FIG. 8. Also shown in FIG. 7A are a web browser application 708, a media player application 710, and JAVA applets 712. The web browser application 708 may be executed by the computer system 880 to browse content and/or the Internet, for example when the computer system 880 is coupled to a network via a wired and/or wireless link. The web browser application 708 may permit a user to enter information into forms and select links to retrieve and view web pages. The media player application 710 may be executed by the computer system 880 to play audio or audiovisual media. The JAVA applets 712 may be executed by the computer system 880 to provide a variety of functionality including games, utilities, and other functionality.

Figure 7B:
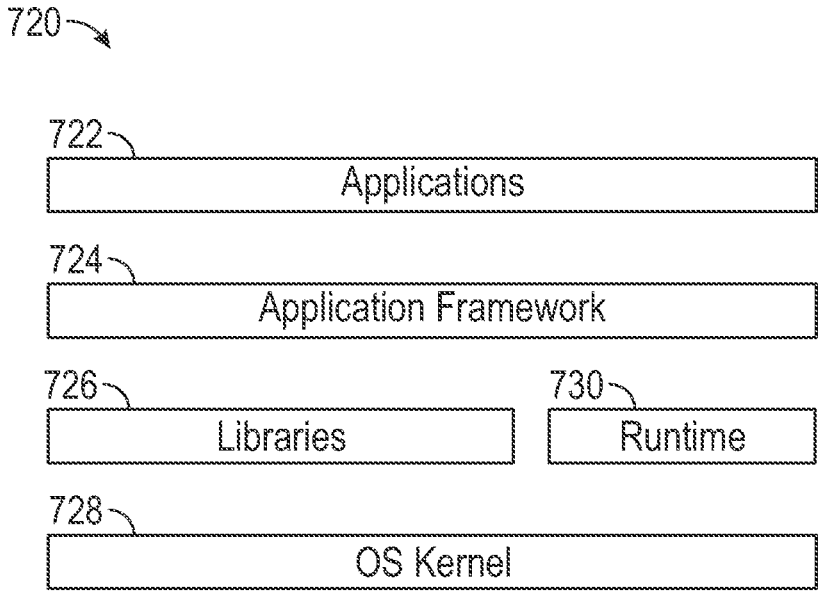
FIG. 7B is a block diagram of another software architecture of a computer system according to an embodiment of the disclosure.

FIG. 7B illustrates an alternative software environment 720 that may be implemented by the CPU 882. The CPU 882 executes operating system kernel (OS kernel) 728 and an execution runtime 730, which reside at the system level of the User Equipment and, in some embodiments, their content (e.g., destination addresses) may not be alterable via download and interaction of software from a server (which may be an embodiment of computer system 880) over a network. The computer system 880 executes applications 722 that may execute in the execution runtime 730 and may rely upon services provided by the application framework 724. Applications 722 and the application framework 724 may rely upon functionality provided via the libraries 726.

FIG. 8 illustrates a computer system 880 suitable for implementing one or more embodiments disclosed herein. The computer system 880 includes a processor 882 (which may be referred to as a central processor unit or CPU) that is in communication with memory devices including secondary storage 884, read only memory (ROM) 886, random access memory (RAM) 888, input/output (I/O) devices 890, and network connectivity devices 892. It is understood that use of the term "memory" or "storage" in the claims does not include transitory signals. The processor 882 may be implemented as one or more CPU chips.

It is understood that by programming and/or loading executable instructions onto the computer system 880, at least one of the CPU 882, the RAM 888, and the ROM 886 are changed, transforming the computer system 880 in part into a particular machine or apparatus having the novel functionality taught by the present disclosure. It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

Additionally, after the system 880 is turned on or booted, the CPU 882 may execute a computer program or application. For example, the CPU 882 may execute software or firmware stored in the ROM 886 or stored in the RAM 888. In some cases, on boot and/or when the application is initiated, the CPU 882 may copy the application or portions of the application from the secondary storage 884 to the RAM 888 or to memory space within the CPU 882 itself, and the CPU 882 may then execute instructions that the application is comprised of In some cases, the CPU 882 may copy the application or portions of the application from memory accessed via the network connectivity devices 892 or via the I/O devices 890 to the RAM 888 or to memory space within the CPU 882, and the CPU 882 may then execute instructions that the application is comprised of. During execution, an application may load instructions into the CPU 882, for example load some of the instructions of the application into a cache of the CPU 882. In some contexts, an application that is executed may be said to configure the CPU 882 to do something, e.g., to configure the CPU 882 to perform the function or functions promoted by the subject application. When the CPU 882 is configured in this way by the application, the CPU 882 becomes a specific purpose computer or a specific purpose machine, sometimes referred to as a special purpose machine.

The secondary storage 884 is typically comprised of one or more disk drives or tape drives and is used for non-volatile storage of data and as an over-flow data storage device if RAM 888 is not large enough to hold all working data. Secondary storage 884 may be used to store programs which are loaded into RAM 888 when such programs are selected for execution. The ROM 886 is used to store instructions and perhaps data which are read during program execution. ROM 886 is a non-volatile memory device which typically has a small memory capacity relative to the larger memory capacity of secondary storage 884. The RAM 888 is used to store volatile data and perhaps to store instructions. Access to both ROM 886 and RAM 888 is typically faster than to secondary storage 884. The secondary storage 884, the RAM 888, and/or the ROM 886 may be referred to in some contexts as computer readable storage media and/or non-transitory computer readable media. I/O devices 890 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 892 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards that promote radio communications using protocols such as code division multiple access (CDMA), global system for mobile communications (GSM), long-term evolution (LTE), worldwide interoperability for microwave access (WiMAX), near field communications (NFC), radio frequency identity (RFID), and/or other air interface protocol radio transceiver cards, and other well-known network devices. These network connectivity devices 892 may enable the processor 882 to communicate with the Internet or one or more intranets. With such a network connection, it is contemplated that the processor 882 might receive information from the network, or might output information to the network in the course of performing the above-described method steps. Such information, which is often represented as a sequence of instructions to be executed using processor 882, may be received from and outputted to the network, for example, in the form of a computer data signal embodied in a carrier wave.

Such information, which may include data or instructions to be executed using processor 882 for example, may be received from and outputted to the network. The processor 882 may generate, for example, a computer data baseband signal or signal embodied in a carrier wave. The baseband signal or signal embedded in the carrier wave, or other types of signals currently used or hereafter developed, may be generated according to several methods well-known to one skilled in the art. The baseband signal and/or signal embedded in the carrier wave may be referred to in some contexts as a transitory signal.

The processor 882 executes instructions, codes, computer programs, scripts which it accesses from hard disk, floppy disk, optical disk (these various disk based systems may all be considered secondary storage 884), flash drive, ROM 886, RAM 888, or the network connectivity devices 892. While only one processor 882 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 884, for example, hard drives, floppy disks, optical disks, and/or other device, the ROM 886, and/or the RAM 888 may be referred to in some contexts as non-transitory instructions and/or non-transitory information.

In an embodiment, the computer system 880 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 880 to provide the functionality of a number of servers that is not directly bound to the number of computers in the computer system 880. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may be comprised on one or more non-transitory computer readable storage medium having computer executable program code embodied therein to implement the functionality disclosed above. The computer program product may comprise data structures, executable instructions, and other computer usable program code. The computer program product may be embodied in removable computer storage media, non-removable computer storage media, or any combination therein. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 880, at least portions of the contents of the computer program product to the secondary storage 884, to the ROM 886, to the RAM 888, and/or to other non-volatile memory and volatile memory of the computer system 880. The processor 882 may process the executable instructions and/or data structures in part by directly accessing the computer program product, for example by reading from a CD-ROM disk inserted into a disk drive peripheral of the computer system 880. Alternatively, the processor 882 may process the executable instructions and/or data structures by remotely accessing the computer program product, for example by downloading the executable instructions and/or data structures from a remote server through the network connectivity devices 892. The computer program product may comprise instructions that promote the loading and/or copying of data, data structures, files, and/or executable instructions to the secondary storage 884, to the ROM 886, to the RAM 888, and/or to other non-volatile memory and volatile memory of the computer system 880.

In some contexts, the secondary storage 884, the ROM 886, and the RAM 888 may be referred to as a non-transitory computer readable medium or a computer readable storage media. A dynamic RAM embodiment of the RAM 888, likewise, may be referred to as a non-transitory computer readable medium in that while the dynamic RAM receives electrical power and is operated in accordance with its design, for example during a period of time during which the computer system 880 is turned on and operational, the dynamic RAM stores information that is written to it. Similarly, the processor 882 may comprise an internal RAM, an internal ROM, a cache memory, and/or other internal non-transitory storage blocks, sections, or components that may be referred to in some contexts as non-transitory computer readable media or computer readable storage media.

Having described various devices, systems, and methods, some embodiments can include, but are not limited to:

In a first embodiment, a system for creating a cementitious building, the system comprises: a support structure comprising a plurality of support members, and an IRS form comprising: a plurality of GCCM sections having GCCM configured to absorb water and rigidize in response to hydration, each GCCM section being coupled to another GCCM section of the plurality such that the IRS form is pneumatically inflatable.

A second embodiment can include the system of the first embodiment, wherein the IRS form comprises a valve that is configured to facilitate pneumatic inflation, hydration of at least one rigidizable connector, or a combination thereof.

A third embodiment can include the system of the first embodiment, further comprising a foundation adapted to support the support structure, wherein the foundation comprises at least one of: a plurality of geosynthetic cementitious composite mats, a poured concrete slab, or a combination thereof.

A fourth embodiment can include the system of the first embodiment, wherein the plurality of support members comprise at least one of: a rigid beam, a rigid beam wrapped with GCCM, or a combination thereof.

A fifth embodiment can include the system of the first embodiment, wherein the IRS form comprises a rectilinear form.

A sixth embodiment can include the system of the first embodiment, wherein the support structure and the IRS form are configured to form a unitary structure upon rigidization of the IRS form.

In a seventh embodiment, a method for creating a cementitious building comprises: inflating an IRS form; forming one or more rectilinear forms from the IRS form using a support structure, wherein the support structure comprises a plurality of support members; rigidizing the IRS form while maintaining the inflation of the IRS form; and forming the cementitious building based on the rigidizing of the IRS form.

An eighth embodiment can include the method of the seventh embodiment, wherein the IRS form comprises a plurality of GCCM sections, each GCCM section of the plurality of GCCM sections being coupled to another GCCM section of the plurality of GCCM sections such that the IRS form is pneumatically inflatable.

A ninth embodiment can include the method of the eighth embodiment, wherein rigidizing the IRS form comprises hydrating the plurality of GCCM sections.

A tenth embodiment can include the method of the ninth embodiment, wherein hydrating includes applying water to at least a portion of each of the plurality of GCCM sections, thereby triggering the GCCM embedded within the plurality of GCCM sections to cure and rigidize.

An eleventh embodiment can include the method of the seventh embodiment, wherein at least a portion of the support members comprise an air beam.

A twelfth embodiment can include the method of the seventh embodiment, further comprising: integrating the plurality of support members with the rigidized IRS form; and supporting the rigidized IRS form using the plurality of support members.

In a thirteenth embodiment, an air beam configured to facilitate creation of a cementitious building comprises: a layer of cementitious composite material coupled together to form a closed structure, wherein the closed structure is inflatable, and wherein the closed structure when inflated forms a structural support element.

A fourteenth embodiment can include the air beam of the thirteenth embodiment, further comprising: a second layer of cementitious composite material coupled to the layer of cementitious composite material; and a plurality of rigidizable connectors disposed between the first layer and the second layer so as to define an air beam cavity between each rigidizable connector, where at least one rigidizable connector is configured to rigidize in response to introduction of water within the air beam cavity.

A fifteenth embodiment can include the air beam of the fourteenth embodiment, wherein each of the rigidizable connectors are coupled between the layer of cementitious composite material and the second layer of cementitious composite material such that the air beam cavity expands in response to pneumatic inflation.

A sixteenth embodiment can include the air beam of the fourteenth embodiment, wherein each of the plurality of rigidizable connectors are disposed between the first layer and the second layer in one or more of an arcuate array, a non-arcuate array, or a combination thereof.

A seventeenth embodiment can include the air beam of the fourteenth embodiment, where the air beam is configured to be pneumatically inflated and receives water within each air beam cavity such that hydration of the rigidizable connectors occurs between the first layer and the second layer and along each air beam cavity in response to reception of water.

An eighteenth embodiment can include the air beam of the fourteenth embodiment, wherein each rigidizable connector comprises cementitious material.

A nineteenth embodiment can include the air beam of the thirteenth embodiment, wherein the layer of cementitious composite material is configured to rigidize in response to hydration with water.

A twentieth embodiment can include the air beam of the thirteenth embodiment, wherein the layer of cementitious composite material is configured to rigidize in response to hydration with water within the closed structure.

In a twenty first embodiment, a system for creating a cementitious building via inflation and hydration comprises: a support structure comprising a plurality of support members, where the plurality of support members of the support structure are configured to provide a framework; and an IRS form comprising: a plurality of GCCM sections having GCCM configured to absorb water and rigidize in response to hydration, each GCCM section being coupled to another GCCM section of the plurality such that the IRS form is pneumatically inflatable without using a separate inflatable bladder inside the IRS form, where the GCCM sections are configured to provide non-planar surfaces for transitioning between planar surfaces of the IRS form in response to pneumatic inflation.

A twenty second embodiment can include the system of the twenty first embodiment, wherein at least one of the plurality of GCCM sections comprises an air beam.

A twenty third embodiment can include the system of the twenty second embodiment, wherein the air beam comprises a first layer, a second layer, and a plurality of rigidizable connectors disposed between the first layer and the second layer.

A twenty fourth embodiment can include the system of the twenty third embodiment, wherein each of the rigidizable connectors are configured between the first layer and the second layer so as to define an air beam cavity between each of the rigidizable connectors.

A twenty fifth embodiment can include the system of the twenty fourth embodiment, wherein at least some of the plurality of rigidizable connectors are disposed between the first layer and the second layer in one or more of an arcuate array, a non-arcuate array, or a combination thereof.

A twenty sixth embodiment can include the system of the twenty third embodiment, where the air beam is configured to receive water such that hydration of the rigidizable connectors occurs between the first layer and the second layer and along each air beam cavity.

A twenty seventh embodiment can include the system of the twenty third embodiment, where the IRS form comprises a valve that is configured to facilitate pneumatic inflation, hydration of at least one rigidizable connector, or a combination thereof.

A twenty eighth embodiment can include the system of the twenty first embodiment, further comprising a foundation adapted to support the support structure, wherein the foundation comprises at least one of: a plurality of geosynthetic cementitious composite mats, a poured concrete slab, or a combination thereof.

In a twenty ninth embodiment, a method of creating a cementitious building via inflation and hydration comprises: providing a foundation adapted to support a support structure, the support structure comprising a plurality of support members; anchoring at least one of the plurality of support members of the support structure to at least a portion of the foundation, where the plurality of support members of the support structure are configured to provide a framework over the foundation; providing an IRS form, where the IRS form comprises a plurality of GCCM sections, each GCCM section being coupled to another GCCM section of the plurality such that the IRS form is pneumatically inflatable, where the GCCM sections are configured to provide non-planar surfaces for transitioning between planar surfaces of the IRS form in response to pneumatic inflation; aligning the IRS form on the foundation such that the framework restrains the IRS form in response to inflation; pneumatically inflating the IRS form; hydrating each of the plurality of GCCM sections of the IRS form while maintaining pneumatic inflation, where each of the GCCM sections comprises a GCCM that is configured to rigidize in response to hydrating; and maintaining pneumatic inflation at least until some of the GCCM sections rigidize based on the hydrating.

A thirtieth embodiment can include the method of the twenty ninth embodiment, where pneumatically inflating the IRS form includes applying a gas directly to an interior surface of the plurality of GCCM sections without using a separate inflatable bladder inside the IRS form.

A thirty first embodiment can include the method of the twenty ninth embodiment, where hydrating includes applying water to at least a portion of each of the plurality of GCCM sections, thereby triggering the GCCM embedded within the plurality of GCCM sections to cure and rigidize.

A thirty second embodiment can include the method of the twenty ninth embodiment, where the IRS form comprises a valve that is configured to facilitate pneumatic inflation.

A thirty third embodiment can include the method of the twenty ninth embodiment, where at least one of the plurality of GCCM sections of the IRS form includes an air beam, the air beam comprising a first layer, a second layer, and a plurality of rigidizable connectors disposed between the first layer and the second layer.

A thirty fourth embodiment can include the method of the thirty third embodiment, wherein each of the plurality of rigidizable connectors are disposed between the first layer and the second layer in one or more of an arcuate array, a non-arcuate array, or a combination thereof; wherein each of the rigidizable connectors are configured between the first layer and the second layer so as to define an air beam cavity between each of the rigidizable connectors.

A thirty fifth embodiment can include the method of the twenty ninth embodiment, wherein the plurality of support members comprise at least one of: a rigid beam, a rigid beam wrapped with GCCM, or a combination thereof.

A thirty sixth embodiment can include the method of the twenty ninth embodiment, further comprising: providing a second IRS form having a second plurality of GCCM sections that are configured to define a second cavity, where the second IRS form is coupled to the IRS form such that the second cavity of the second IRS form adapted to be in fluid communication with a first cavity of the IRS form.

A thirty seventh embodiment can include the method of the thirty sixth embodiment, further comprising: pneumatically inflating the second IRS form; hydrating each of the second plurality of GCCM sections of the second IRS form while maintaining pneumatic inflation; maintaining pneumatic inflation of the second IRS form until at least some of the second plurality of GCCM sections rigidize based on hydrating the second plurality of GCCM sections.

A thirty eighth embodiment can include the method of the thirty seventh embodiment, where each of the second plurality of GCCM sections comprises a GCCM that is configured to rigidize in response to hydrating; and where inflation of each of the IRS form and the second IRS form are maintained until each of the first plurality of GCCM sections and the second plurality of GCCM sections rigidize based on hydrating.

In a thirty ninth embodiment, a method for creating a cementitious building via inflation and hydration comprises: providing an IRS form that comprises a plurality of GCCM (GCCM) sections, at least one of the plurality of GCCM sections comprising an air beam; pneumatically inflating the IRS form without using a separate inflatable bladder inside the IRS form; hydrating each of the plurality of GCCM sections of the IRS form while maintaining pneumatic inflation, where each of the GCCM sections comprises a GCCM that is configured to rigidize in response to the hydrating; and subsequent to hydrating, maintaining pneumatic inflation until at least some of the GCCM sections rigidize based on the hydrating.

A fortieth embodiment can include the method of the thirty ninth embodiment, wherein the air beam comprises a first layer, a second layer, and a plurality of rigidizable connectors disposed between the first layer and the second layer.

A forty first embodiment can include the method of the fortieth embodiment, wherein at least some of the plurality of rigidizable connectors are disposed between the first layer and the second layer in one or more of an arcuate array, a non-arcuate array, or a combination thereof.

A forty second embodiment can include the method of the fortieth embodiment, wherein each of the rigidizable connectors are configured between the first layer and the second layer so as to define an air beam cavity between each of the rigidizable connectors.

A forty third embodiment can include the method of the forty second embodiment, wherein hydrating includes introducing water within the air beam such that hydration of the rigidizable connectors occurs between the first layer and the second layer and along each air beam cavity.

In a forty fourth embodiment, a system for providing an IRS form to facilitate construction of a cementitious building via inflation and hydration comprises: a computer system communicatively coupled to an automated sewing machine, the computer system comprising: a processor communicatively coupled to a non-transitory memory storing an application that configures the processor upon execution such that the computer system: receives input of three dimensional coordinates defining a plurality of material sections to create the IRS form, detects a transition in orientation between two of the plurality of material sections based on the three dimensional coordinates, determines that the transition corresponds with material sections forming one or more of a non-planar surface, an oblique angle, a right angle, or a combination thereof, and pulls, from non-transitory memory based on the determined transition, a securing pattern for physically coupling material sections together.

A forty fifth embodiment can include the system of the forty fourth embodiment, wherein each of the material sections comprise GCCM.

A forty sixth embodiment can include the system of the forty fourth embodiment, wherein the securing pattern is one of a plurality of securing patterns stored in non-transitory memory. The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented. The particular naming of the components, capitalization of terms, the attributes, structures, or any other structural aspect is not mandatory or significant, and the mechanisms that implement the disclosure or its features may have different names, formats, or protocols. Also, the particular division of functionality between the various components described herein is merely exemplary, and not mandatory; functions performed by a single system component may instead be performed by multiple components, and functions performed by multiple components instead may be performed by a single component. Finally, it should be noted that the language used in the specification bas been principally selected for readability and instructional purposes, and may not have been selected to delineate or circumscribe the subject matter.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. The word "exemplary" is used herein to mean "serving as an example, instance, or illustration." Any implementation described herein as "exemplary" is not necessarily to be construed as preferred or advantageous over other implementations. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A system for creating a cementitious building, the system comprising:

a support structure comprising a plurality of support members, and an inflatable rigidizable structural (IRS) form comprising:

a plurality of geosynthetic cementitious composite mat (GCCM) sections having GCCM configured to absorb water and rigidize in response to hydration, each GCCM section being coupled to another GCCM section of the plurality such that the IRS form is pneumatically inflatable.

2. The system of claim 1, wherein the IRS form comprises a valve that is configured to facilitate pneumatic inflation, hydration of at least one rigidizable connector, or a combination thereof.

3. The system of claim 1, further comprising a foundation adapted to support the support structure, wherein the foundation comprises at least one of: a plurality of geosynthetic cementitious composite mats, a poured concrete slab, or a combination thereof.

4. The system of claim 1, wherein the plurality of support members comprise at least one of: a rigid beam, a rigid beam wrapped with GCCM, or a combination thereof.

5. The system of claim 1, wherein the IRS form comprises a rectilinear form.

6. The system of claim 1, wherein the support structure and the IRS form are configured to form a unitary structure upon rigidization of the IRS form.

7. The system of claim 1, wherein the support structure comprises an air beam, and where the air beam comprises:

a first layer of cementitious composite material coupled together to form a closed structure, wherein the closed structure is inflatable, and wherein the closed structure when inflated forms a structural support element.

8. The system of claim 7, further comprising:

a second layer of cementitious composite material coupled to the layer of cementitious composite material of the air beam; and a plurality of rigidizable connectors disposed between the first layer and the second layer so as to define an air beam cavity between each rigidizable connector, where at least one rigidizable connector is configured to rigidize in response to introduction of water within the air beam cavity.

9. The system of claim 8, wherein each of the rigidizable connectors are coupled between the layer of cementitious composite material and the second layer of cementitious composite material such that the air beam cavity expands in response to pneumatic inflation.

10. The system of claim 8, wherein each of the plurality of rigidizable connectors are disposed between the first layer and the second layer in one or more of an arcuate array, a non-arcuate array, or a combination thereof.

11. The system of claim 8, where the air beam is configured to be pneumatically inflated and receives water within each air beam cavity such that hydration of the rigidizable connectors occurs between the first layer and the second layer and along each air beam cavity in response to reception of water.

12. The system of claim 8, wherein each rigidizable connector comprises cementitious material.

13. The system of claim 7, wherein the layer of cementitious composite material is configured to rigidize in response to hydration with water.

14. The system of claim 7, wherein the layer of cementitious composite material is configured to rigidize in response to hydration with water within the closed structure.

15. The system of claim 7, wherein the air beam is configured to be inflated separately from the IRS form.

16. The system of claim 7, wherein the layer of cementitious composite material of the air beam engages the GCCM sections of the IRS form, and wherein the layer of cementitious composite material and the GCCM sections are configured to fuse together when hydrated and cured.

17. The system of claim 1, wherein the plurality of GCCM sections, when coupled together, form planar wall sections.

18. The system of claim 17, wherein the plurality of GCCM sections, when coupled together, comprise non-planar sections between the planar wall sections.

19. The system of claim 1, wherein the GCCM comprises a first surface, a second surface, and a cementitious matrix material disposed between the first surface and the second surface, wherein at least one of the first surface or the second surface is permeable to water.

20. The system of claim 19, wherein the cementitious matrix material comprises a fiber matrix with a dry concrete mix.

* * * * *